US008152017B2

(12) United States Patent
Lizerbram et al.

(10) Patent No.: US 8,152,017 B2
(45) Date of Patent: Apr. 10, 2012

(54) CONTAINER CLOSURE WITH ADDITIVE RESERVOIR

(75) Inventors: Eric K. Lizerbram, Carlsbad, CA (US); Gerry R. Krippner, Oceanside, CA (US); Todd G. Buchholz, Solana Beach, CA (US); William S. Anapoell, San Diego, CA (US)

(73) Assignee: Eric K. Lizerbram, Carlsbad, CA (US)

( * ) Notice: Subject to any disclaimer, the term of this patent is extended or adjusted under 35 U.S.C. 154(b) by 53 days.

(21) Appl. No.: 12/341,266

(22) Filed: Dec. 22, 2008

(65) Prior Publication Data

US 2009/0236303 A1 Sep. 24, 2009

Related U.S. Application Data

(63) Continuation-in-part of application No. 12/025,345, filed on Feb. 4, 2008, now abandoned.

(51) Int. Cl.

| | |
|---|---|
| ***B65D 41/56*** | (2006.01) |
| ***B65D 51/18*** | (2006.01) |
| ***B65D 39/00*** | (2006.01) |
| ***B65D 41/00*** | (2006.01) |

(52) U.S. Cl. ..... 220/254.9; 222/145.1; 222/145.4; 222/544; 222/566; 215/227; 206/219; 206/222

(58) Field of Classification Search ..... 220/212, 220/254.9; 222/80, 145.4, 153.13, 386, 544, 222/566, 145.1; 215/227, DIG. 8; 206/219, 206/221, 222

See application file for complete search history.

(56) References Cited

U.S. PATENT DOCUMENTS

| | | | |
|---|---|---|---|
| 3,248,350 | A | 4/1966 | Triggle, Ann M. |
| 4,129,666 | A | 12/1978 | Wizerkaniuk |
| 5,154,938 | A | 10/1992 | Broderick et al. |

(Continued)

FOREIGN PATENT DOCUMENTS

| | | | |
|---|---|---|---|
| WO | WO-03/101858 | A2 | 12/2003 |

(Continued)

OTHER PUBLICATIONS

International Search Report of PCT/US2008/081806 dated Jun. 11, 2009.

*Primary Examiner* — Anthony Stashick
*Assistant Examiner* — Madison L Wright
(74) *Attorney, Agent, or Firm* — Millen, White, Zelano & Branigan, P.C.

(57) ABSTRACT

A closure with an additive reservoir is mounted on a container for a consumable liquid. The closure has a base, which includes the additive reservoir; a spout mounted on the base; a plunger positioned in the additive reservoir, and an outer cap. Upon advancing the plunger, an additive in the reservoir is released into the consumable liquid after the additive or plunger ruptures or otherwise opens a barrier provided by a foil, membrane or plug. Upon moving the spout from a first position on the base to a second position, a passageway through the base is opened and the consumable liquid flows to the consumer without having to remove the closure. The additive chamber is mounted in a support column of the base with the passageway for the consumable liquid being disposed between the additive chamber and the support column. In a preferred embodiment the additive is the sole pressure link between the plunger and barrier.

27 Claims, 29 Drawing Sheets

U.S. PATENT DOCUMENTS

| | | | | |
|---|---|---|---|---|
| 5,249,712 | A | 10/1993 | Lontrade et al. | |
| 5,474,209 | A | 12/1995 | Vallet Mas et al. | |
| 5,683,719 | A | 11/1997 | Newton | |
| 5,882,682 | A | 3/1999 | Rork et al. | |
| 6,152,296 | A | 11/2000 | Shih | |
| 6,170,654 | B1 * | 1/2001 | Gartner et al. | 206/219 |
| 6,477,743 | B1 * | 11/2002 | Gross et al. | 222/525 |
| 6,503,541 | B1 | 1/2003 | Moon et al. | |
| 6,632,451 | B2 | 10/2003 | Penhasi et al. | |
| 6,705,462 | B2 | 3/2004 | Kasuya | |
| 6,705,490 | B1 | 3/2004 | Lizerbram et al. | |
| 6,705,491 | B1 | 3/2004 | Lizerbram et al. | |
| 6,935,493 | B2 | 8/2005 | Cho | |
| 6,959,839 | B2 * | 11/2005 | Roth et al. | 222/83 |
| 7,107,783 | B2 | 9/2006 | Smolko et al. | |
| 7,249,690 | B2 | 7/2007 | Smith et al. | |
| 2002/0020636 | A1 * | 2/2002 | Bergamini et al. | 206/219 |
| 2004/0137156 | A1 | 7/2004 | Lee et al. | |
| 2004/0251276 | A1 * | 12/2004 | Adams et al. | 222/153.14 |
| 2006/0104909 | A1 | 5/2006 | Vaghhefi et al. | |
| 2009/0127155 | A1 * | 5/2009 | Nottoli et al. | 206/531 |

FOREIGN PATENT DOCUMENTS

| | | | |
|---|---|---|---|
| WO | WO-2004/024587 | A2 | 3/2004 |
| WO | WO-2006/052827 | A2 | 5/2006 |

* cited by examiner

CONTAINER CLOSURE WITH ADDITIVE RESERVOIR

RELATED PATENT APPLICATIONS

This application is a continuation-in-part of U.S. patent application Ser. No. 12/025,345, filed Feb. 4, 2008 now *abandoned*.

FIELD OF THE INVENTION

The present invention is directed to a container closure with an additive reservoir. More particularly, the present invention is directed to a container closure with an additive reservoir wherein the closure is used to close a container containing a liquid, such as but not limited to, a consumable liquid, and wherein the reservoir is opened to the container prior to using or consuming the liquid to allow the additive to mix with and enhance the consumable liquid.

BACKGROUND OF THE INVENTION

In order to enhance the experience or benefit of drinking a consumable liquid, an additive or additives may be added to the consumable liquid. As is disclosed in Applicants' U.S. Pat. Nos. 6,705,490 and 6,705,491, additives may be dispensed from a reservoir in the closure of a consumable liquid container. In these two patents, after an additive from a reservoir in a closure is mixed with a consumable liquid, the consumable liquid is dispensed from the consumable liquid container directly through the closure. Thus there is no need to remove the closure from the container in order to consume the consumable liquid.

Examples of additives which can enhance appeal and value of a consumable liquid are various colorants. Many consumable liquids are clear but would be more marketable if in various colors, which for example are indicative of various flavors. Other examples of additives which can be added to consumable liquids are vitamins and other health related substances. Additives which enhance visuals, taste, flavor and other properties of a consumable liquid may also be dispensed from the reservoir in the closure.

SUMMARY OF THE INVENTION

A closure with an additive reservoir for use with a container for liquids is comprised of a base including a reservoir for attachment to the container; a plunger that cooperates with the reservoir to release the additive into the liquid, and a spout mounted on the base and moveable to a position allowing the liquid mixed with the additive to be dispensed through the closure without removing the closure from the container. Where the additive is a liquid, pressure by the plunger on the liquid is sufficient to open a barrier retaining the liquid in the reservoir.

In a further aspect of the closure, a tamper-proof, dust resistant cap encloses the spout and plunger, the cap being removable before the consumer consumes the liquid. The cap is preferably rigid and hard.

In a further aspect of the closure, the closure comprises a base member including the reservoir in the form of an additive chamber for containing the additive and a passageway for allowing a liquid in the additive container to flow from the additive container to a consumer. The closure further comprises a plunger in the additive chamber for causing the additive in the chamber to flow out of the chamber and into the liquid upon the plunger being depressed. A spout is movably disposed on the base around the additive chamber and around the passageway. The spout has a sealing relationship with the passageway when in a first position and a non-sealing relationship with the passageway when in a second position, whereby upon activating the plunger to release the additive into the liquid by moving the plunger from a first to a second position, the liquid, together with the additive, can flow through the container opening to the consumer.

In a further aspect of the closure, the base has a collar portion for attachment to the container and a support column for mounting the plunger on the base for movement between the first and second positions.

In a further aspect of the closure, the additive chamber is positioned in the support column of the base with a passageway between the additive chamber and the support column for dispensing the liquid.

In a further aspect of the closure, a stop arrangement is disposed between the plunger in the chamber to block the plunger from sliding out of the chamber both before and after the plunger is depressed.

In a further aspect of the closure, the base, additive chamber, plunger and spout are concentric.

In a further aspect of the closure, the additive is in the form of granules, powder, gel and/or a liquid.

In a further aspect of the closure where the additive is a particulate solid, such as a powder, a projection extends from the plunger and dislodges or ruptures the barrier prior to the plunger advancing to push the particulate solid from the additive chamber.

In a further aspect of the closure, the additive is a solid configured to transmit sufficient force from the plunger to the barrier to open the barrier by direct engagement by the additive.

In a further aspect of the closure, the height of the plunger is substantially less than the length of the additive chamber to minimize the initial height of the closure prior to advancing the plunger.

In a further aspect of the closure an effervescent material is dispensed into the additive to help propel the additive from the additive chamber.

In a further aspect of the closure, the plunger is advanced by depressing the plunger.

In a further aspect of the closure, the plunger is advanced by rotation of the plunger.

In a further aspect of the invention the additive chamber projects above the base to a height substantially the same as the height of the spout.

In still a further object of the invention, the closure is in combination with the container.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
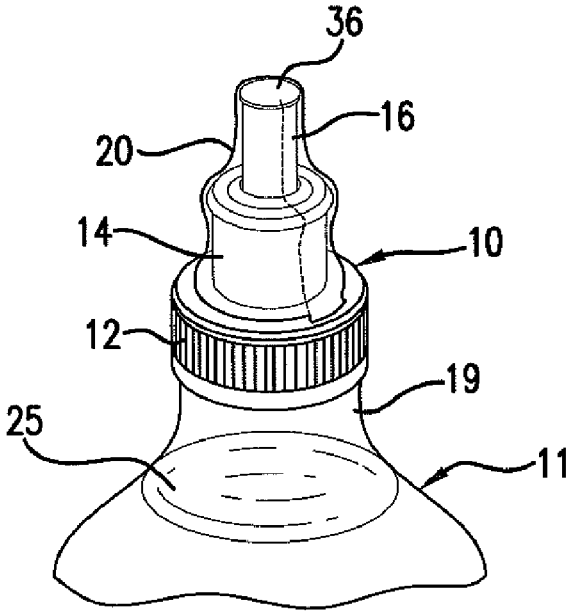
FIG. 1 is a perspective view of a closure containing an additive and being mounted on a container containing a liquid.

Referring now to FIG. 1, there is shown a closure 10, configured in accordance with the principles of the present invention and mounted on a container 11 containing a consumable liquid. The consumable liquid may be, but is not limited to, a beverage, a component of a health aide or a medicinal agent. The closure 10 is comprised of a base 12, a spout 14 and a plunger 16 with the base 12 containing an additive and being mounted on the container 11 by a collar 18. The collar 18 may be in the form of a threaded collar that threads with the neck in 19 of the container 11. In order to protect the closure 10 from unauthorized access to the plunger 16, a plastic cap 20 is disposed over the plunger and the plunger is secured to the base 12 with a plastic band. The cap 20 prevents the plunger 16 from being easily depressed by people who are not purchasers.

Figure 2:
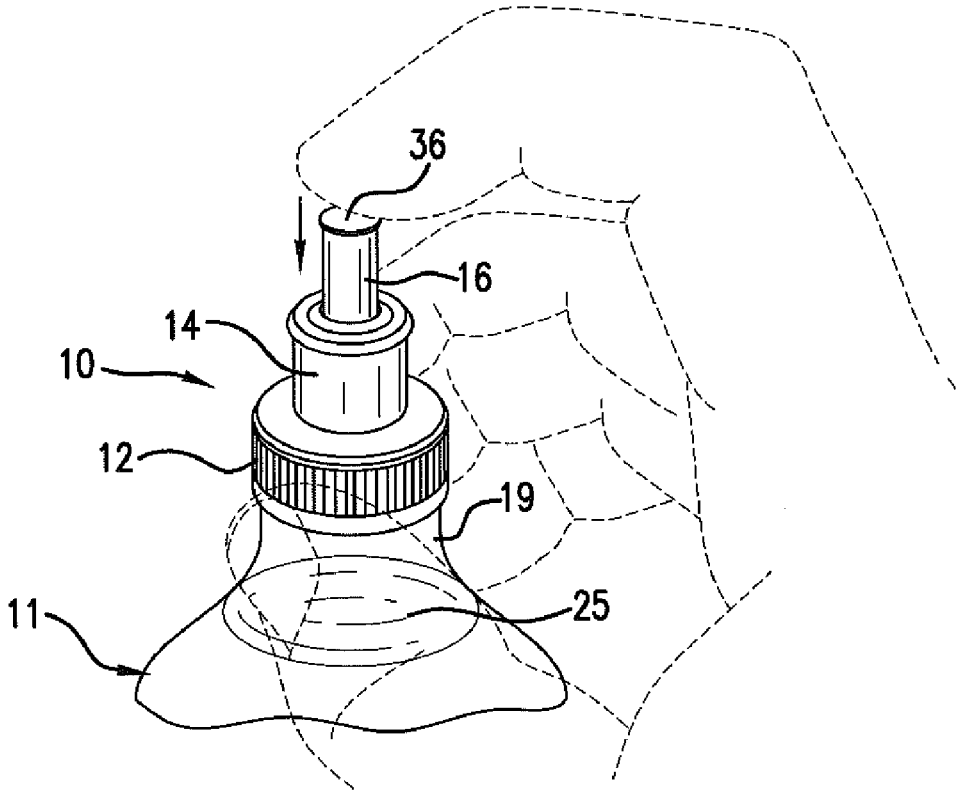
FIG. 2 is a perspective view similar to FIG. 1, but illustrating a plunger mounted in the closure and being depressed to release the additive into the liquid.
Figure 3:
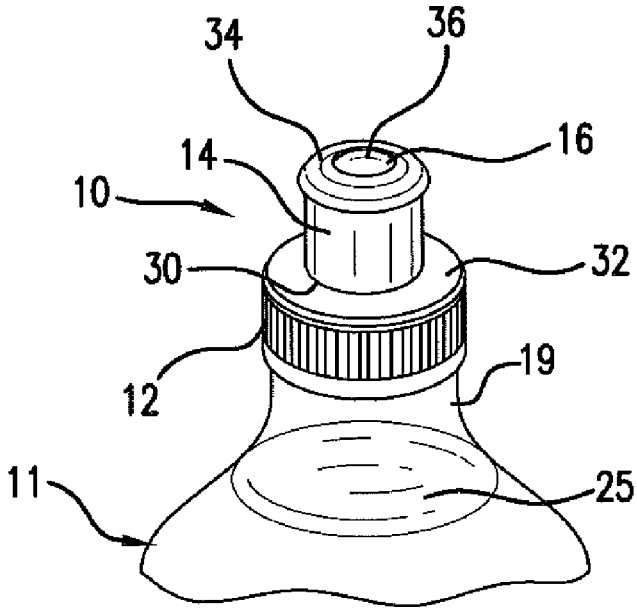
FIG. 3 is a perspective view similar to FIGS. 1 and 2 but showing the plunger depressed.

Referring now to FIGS. 2 and 3, the plastic cap 20 is removed from the closure 10 so that plunger 16 and the spout 14 are able to move with respect to the base 12 in order to allow an additive in the base 12 to be released into the container 11. Consequently, the consumable liquid 25 in the container 11 mixes with the additive. As is evident from FIG. 2, this is accomplished by pressing the plunger 16 with a finger, such as a forefinger or thumb to move the plunger toward the container 11 and into the base 12 of the closure 10, as is shown in FIG. 3.

As is further seen in FIG. 3, the spout 14 has a bottom end 30 in engagement or close proximity with the top surface 32 of the closure 10. A top surface 34 of the spout is substantially flush with a top flange 36 on the now depressed plunger 16. As will be explained hereinafter, the closure 10 is still closed preventing dispensing of the consumable liquid 25 although the additive has been released into the consumable liquid by depressing the plunger 16.

Figure 4:
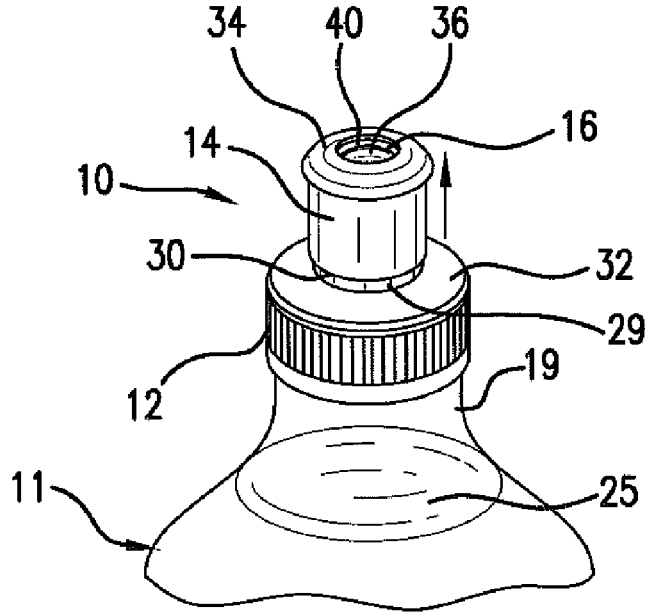
FIG. 4 is a perspective view similar to FIGS. 1-3 but showing a spout mounted around a column on the base and lifted to open the closure so that the contents thereof can be dispensed to a consumer.
Figure 5:
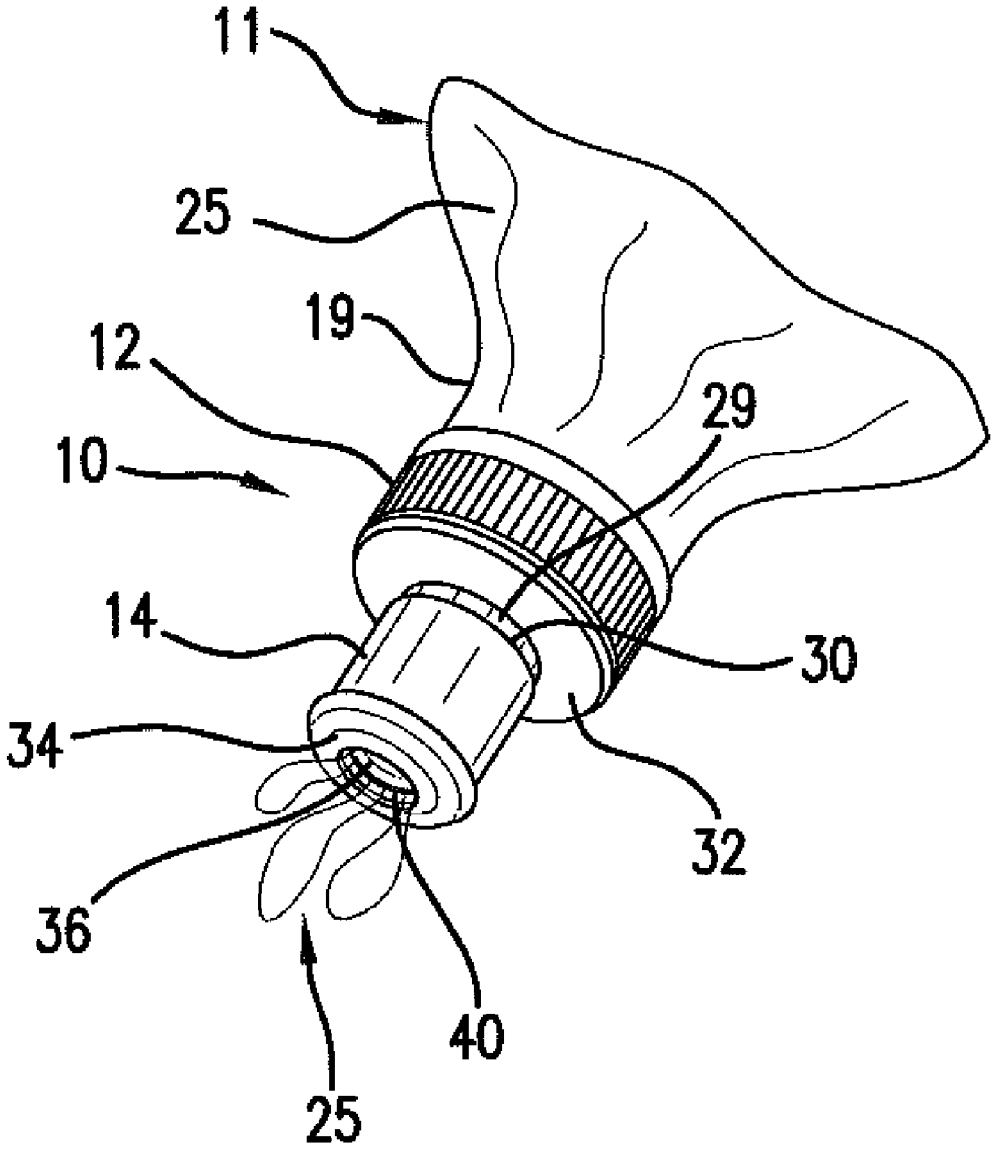
FIG. 5 is a perspective view similar to FIGS. 1-4 but showing liquid from the container being dispensed through the closure.

Referring to now to FIGS. 4 and 5, the spout 14 has been moved from a first position to a second position on a column 29 that projects from the base 12, wherein the bottom 30 of the spout is displaced from the top surface 32 of the base 12 instead of being in abutment or close proximity therewith. As will be explained hereinafter, this opens a passageway 40 between the plunger 16 and the spout 14 to allow the consumable liquid 25 in the container 11, now mixed with the additive from the base 12, to flow through the passageway and out the container when the container is tilted, as is seen in FIG. 5.

The plunger 16 and spout 14 are positioned in proximity to one another so that in moving from the first position of FIG. 3 to the second position of FIG. 4, the plunger 16 may be pushed down or depressed by the thumb of the customer while the spout 14 is gripped between the index and forefinger and pulled away from the top surface 32 of the base 12 to open the passageway 40. When the container 11 is held in the other hand of the consumer the container is easily tilted to drain the liquid 25, now mixed with an additive, into the mouth, cup or glass of the consumer.

Figure 6:
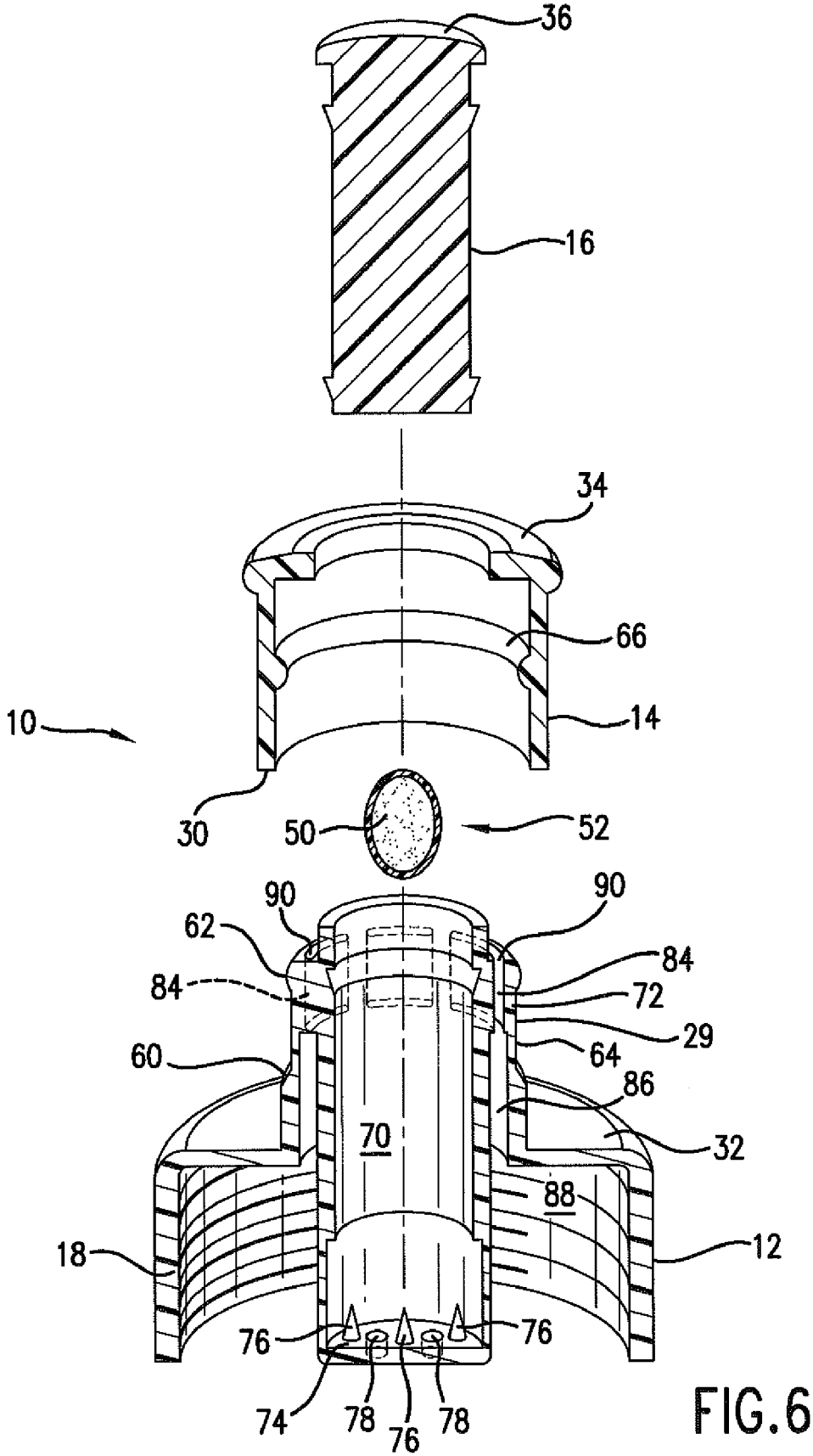
FIG. 6 is an exploded view of the closure showing the three parts comprising the closure, as well as an additive in the form a rupturable capsule.

Referring now to FIG. 6, where the closure 10 is shown exploded, it is seen that the closure is comprised of three parts that are readily assembled by a machine. Machine assembly is facilitated when an additive 50 is contained within a capsule 52 having a wall 53 that is rupturable upon depressing the plunger 16. The capsule 52 preferably is made of a fragile gelatin material and preferably has an impermeable coating, such as a hydrophobic coating, which is crushable to release the additive 50. Preferably, the base 12, the collar 14 and the plunger 16 are concentric and made from a plastic material.

Figure 7:
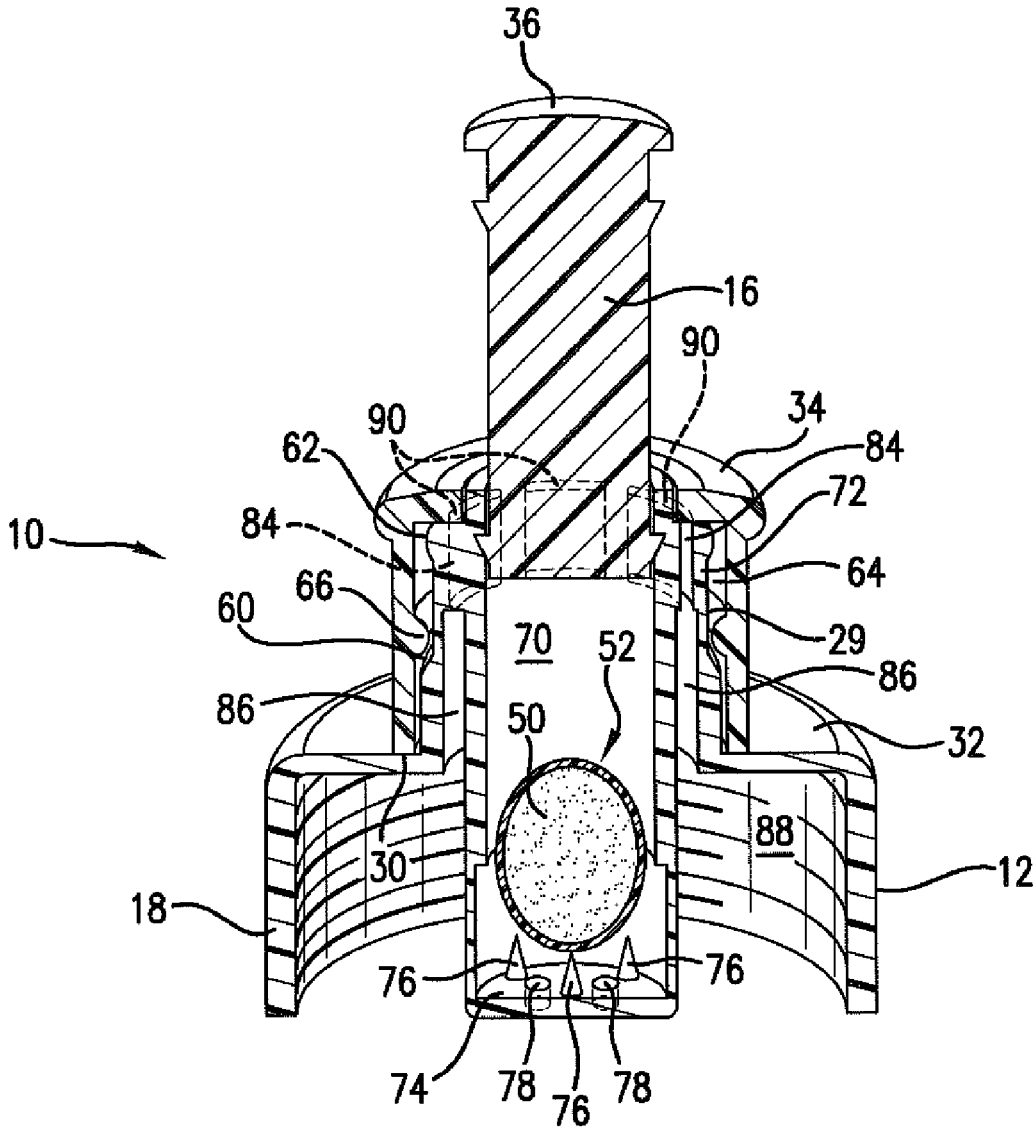
FIG. 7 is an elevation of the closure parts of FIG. 6 assembled.
Figure 8:
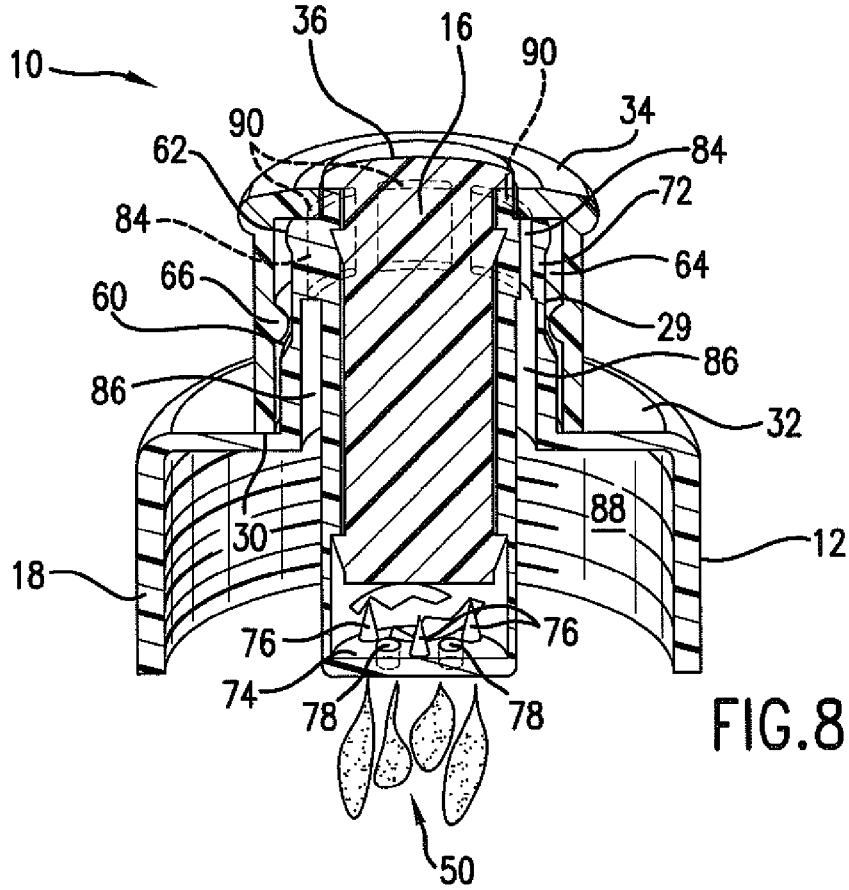
FIG. 8 is a view similar to FIG. 7, but showing the plunger depressed and additive in the capsule being released from the additive chamber and showing a spout in a first position, preventing liquid in the container to which the closure is attached from passing through the closure.
Figure 9:
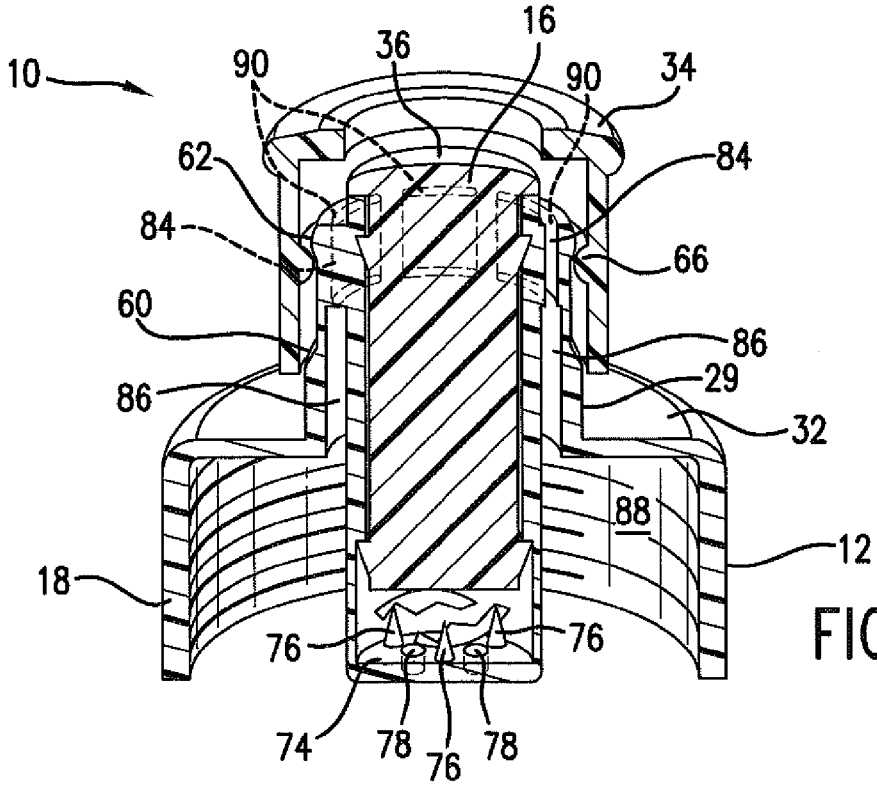
FIG. 9 is a view similar to FIG. 8 showing the spout moved to a second position allowing liquid to pass through the closure from the container on which the closure is connected.

FIGS. 7, 8 and 9 show the components of FIG. 6 assembled with the capsule 52 within the base 12. The collar 18 of the base 12 is preferably threaded for coupling with a threaded neck 19 of the container 11. Other arrangements such as adhesion or crimping may be utilized to accomplish a coupling between the collar 18 and the container 11, or the base 12 may even be integral with the container 11. The support column 29 projects upwardly from the top service 32 of the base 12 to support the spout 14. Around of the support column 29 there are two shoulders 60 and 62 between which there is a gap 64. A circular rib 66, projecting inwardly from the inner surface 68 of the spout 14, is received in the gap 64 to retain the spout 14 on the support column 29. When the spout 14 is in the first position shown in FIGS. 7 and 8 (and FIGS. 1 and 2), the spout 14 is down and in abutment with the annular upper surface 32 of the base 12. When the spout 14 is in the second position shown in FIG. 9 (and FIGS. 4 and 5), the inner annular rib 66 on the spout is in engagement with the outer annular shoulder 62 on the support column 29.

The support column 29 also supports a cylindrical reservoir 70 that has the plunger 16 slidably received therein. The reservoir 70 defines an additive chamber 71 that contains the capsule 52 and the reservoir 70 is connected to the support column 29 by an annular bridge 72. As is seen in FIG. 8, the floor 74 of the reservoir 70 has at least one conical blade 76 in the form of a punch that punctures or ruptures the capsule 52 to release the additive 50 therefrom into the chamber 72 when the plunger 16 presses against the capsule. The floor 74 has at least one opening 78 through which the released additive 50 drains into the liquid 25. The at least one opening 78 can be a central opening, or any opening allowing the additive 50 to flow into the consumable liquid 25. The opening 78 could also be in the form of peripheral slots 78 disposed in the floor 74 or disposed between the floor and the inner surface of the wall of the cylindrical reservoir 70.

By having projection the additive chamber 71 above the top surface 32 of the base 12 limited to or slightly less than the height of the spout 14 when the spout 14 is in the first or closed portion, the height of the closure 10 is minimized.

The annular bridge 72 has slots 84 that communicate with an annular channel 86 that opens to a space 88 defined by the collar wall 18 to form the aforementioned passageway 40. Consequently, liquid 25 from the container 11 can flow through the passageway 40 as long as the passageway 40 is not blocked as in FIG. 8 where the top annular flange 34 of the spout 14 covers outlets 90 of the slots 84. Upon shifting the spout 14 from its first position in FIG. 8 to its second position in FIG. 9 where the annular flange 34 on the spout clears the top edge 92 of the support column 29, the passageway 40 becomes unblocked by the annular flange 34, allowing liquid to flow past the support column 29 and thus through the closure 10 to the consumer.

Figure 10:
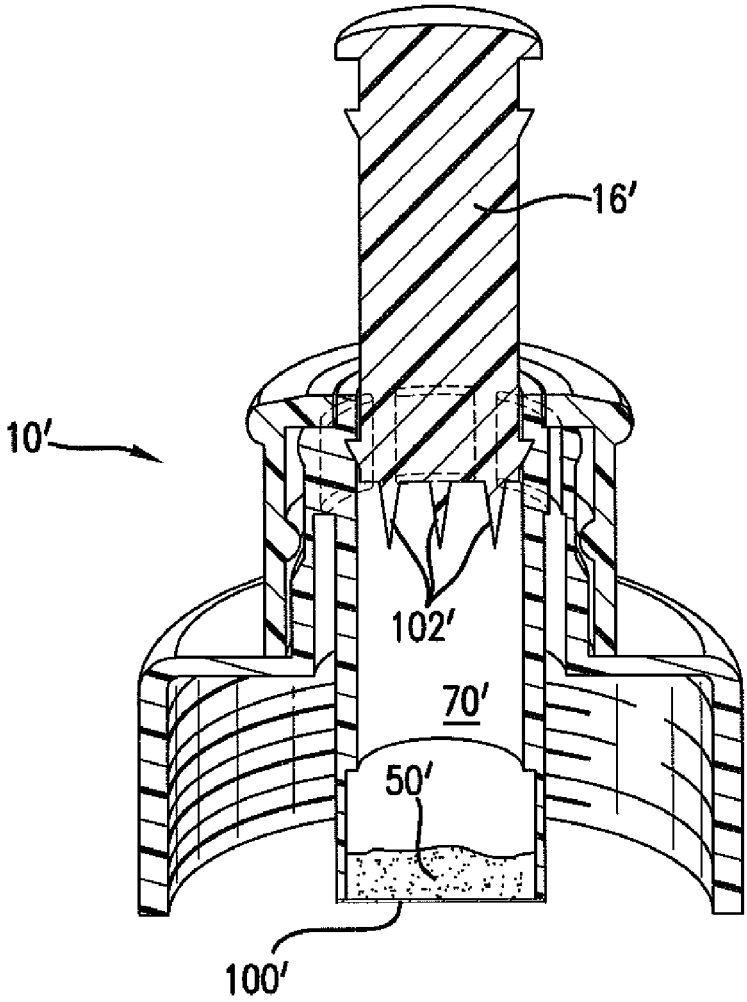
FIG. 10 is a perspective view of a second embodiment of the invention.
Figure 11:
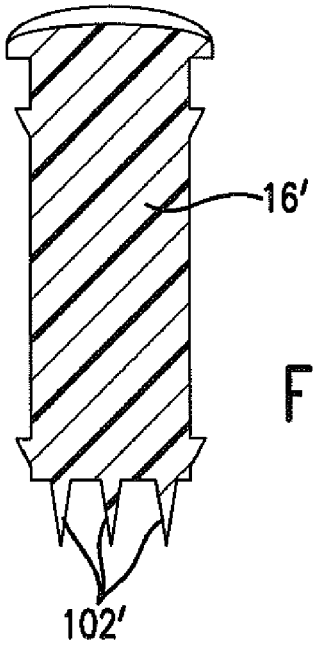
FIG. 11 is a perspective view of a plunger used with the second embodiment of the invention.

In the second embodiment of the invention illustrated by the closure 10' shown in FIGS. 10 and 11, the bottom of the reservoir 70' is covered by foil 100' and the additive 50' is in the form of a powder, pills or liquid. The plunger 16' has a projection 102' thereon which punctures or ruptures the foil 100 to allow the additive 50 to drain or fall into the liquid 25 when the plunger is depressed.

Figure 12:
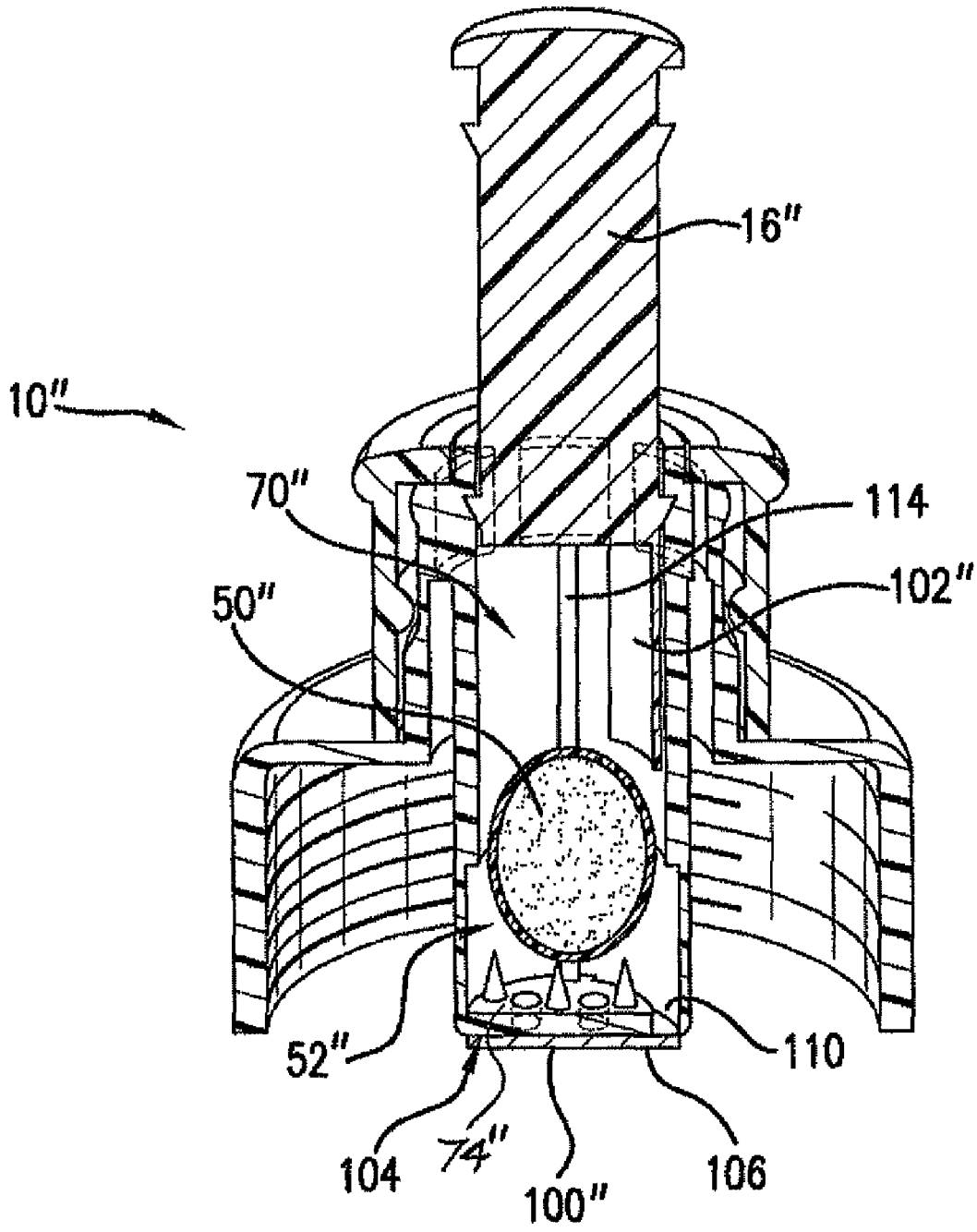
FIG. 12 is a perspective view of a third embodiment of the invention wherein a sealing barrier is shown used with an additive capsule.
Figure 13:
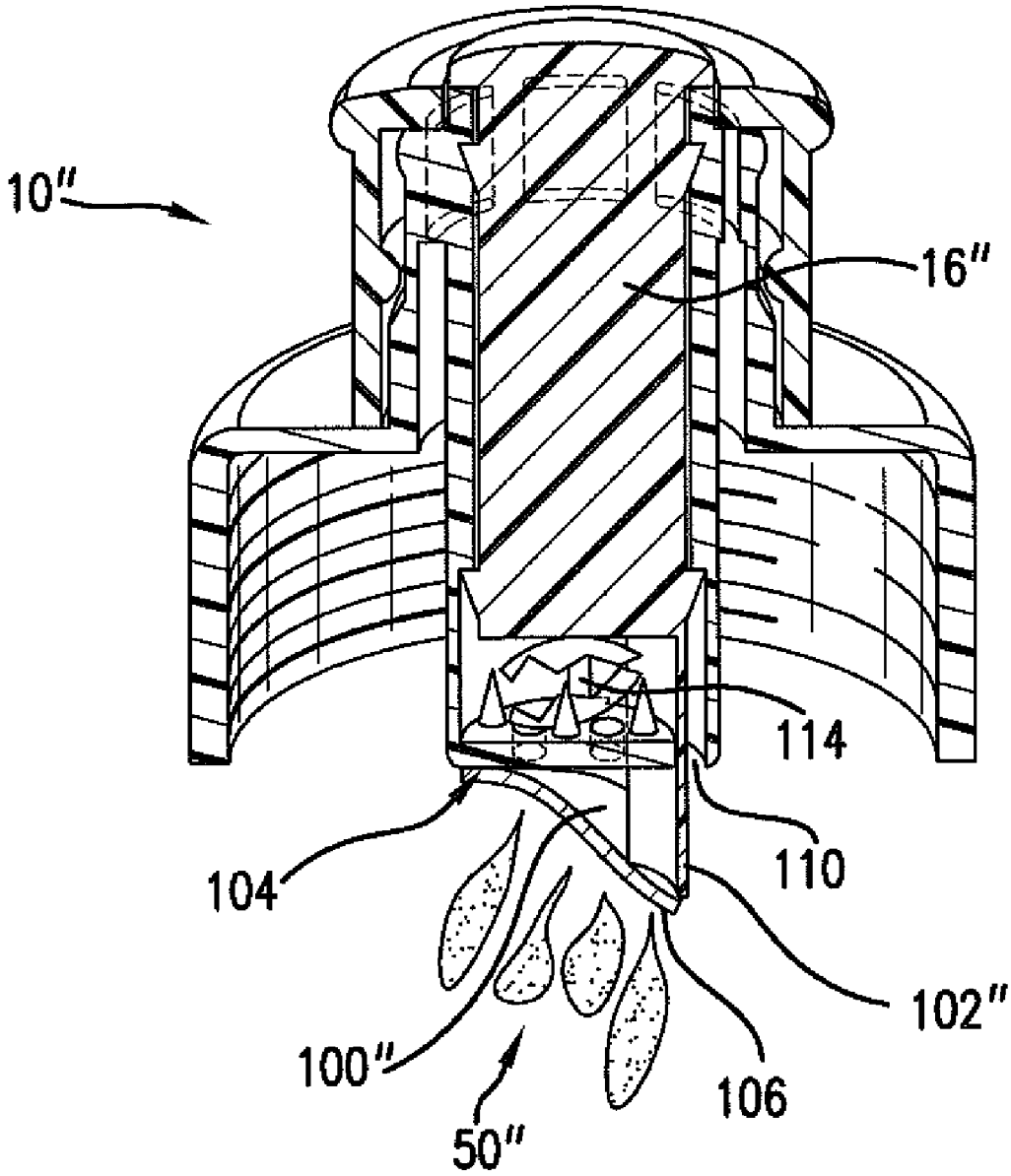
FIG. 13 is a perspective view showing the operation of the plunger and sealing barrier.

Referring now to the third embodiment of the invention shown in FIGS. 12 and 13, if the wall 53 of the capsule 52 is not hydrophobic and is permeable by the consumable liquid 25, it is necessary to use a barrier such as the barrier 100" between the capsule 52 and the consumable liquid 25. In the embodiment shown, the barrier 100" is adhered by heat sealing it very strongly to the floor 74" at one peripheral location 104 beneath the floor and heat sealing it less strongly along the remainder of its periphery at location 106 beneath the floor. The plunger 16" has a depending blade 102" which is arcuate and passes an arcuate slot 110 in the floor 74" of the reservoir 70" to engage and dislodge the barrier 100" along the periphery 106. Thereafter, the capsule 52 is crushed by the plunger 16" against the punches 76, releasing the additive 50 to flow through the openings 78 through the floor 74". The barrier 100" is preferably a metal foil although it can also be made of plastic film. The strong adhesion at location 104 provides a hinge that allows the barrier 100" to remain attached to the reservoir 70" and not fall into the container. The plunger 16" is prevented from rotating by a longitudinal rib 114 on the inner wall of the reservoir 70", which rib engages a longitudinal groove (not shown) in the plunger.

Figure 14:
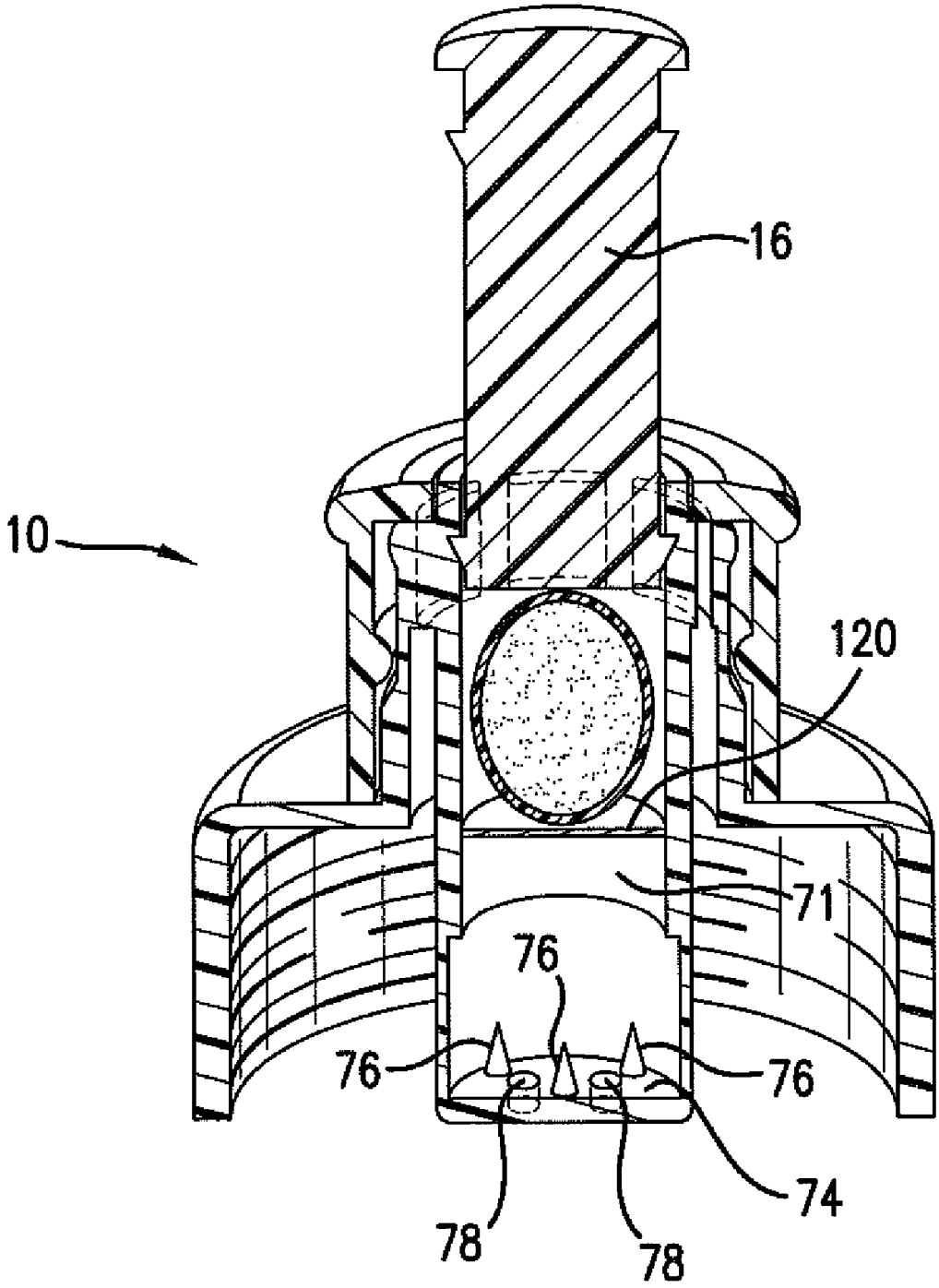
FIG. 14 is a perspective view of a fourth embodiment of the invention.

Referring to FIG. 14, a fourth embodiment of the invention, a breakable barrier such as a foil or membrane 120 is heat sealed or otherwise adhered in the cavity 71 in spaced relation to the floor 74. Pressure from the plunger 16 applied through the capsule 52 breaks the foil or membrane 122 allowing the capsule to pass through the foil or membrane and be crushed against punches or blades 76 on the floor 74.

Figure 15:
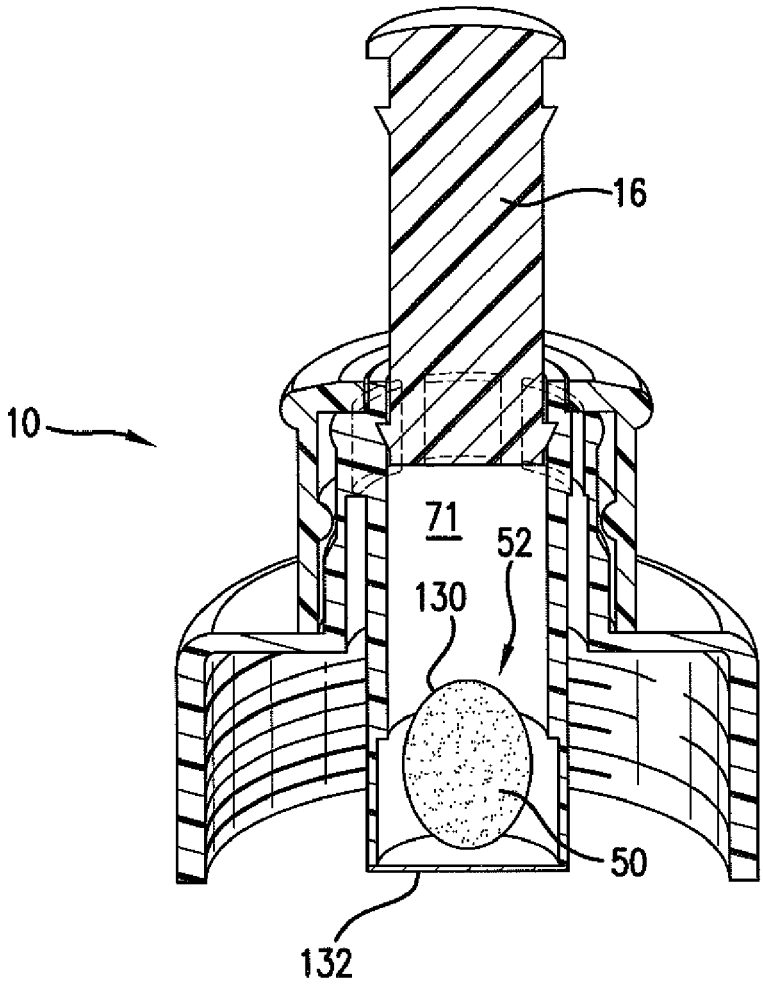
FIG. 15 is a perspective view of a fifth embodiment of the invention prior to releasing the capsule into the liquid.
Figure 16:
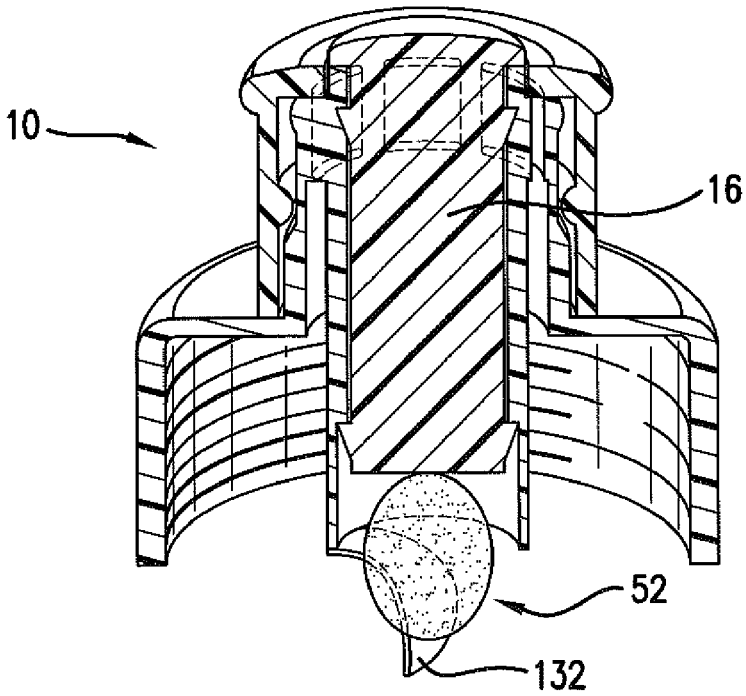
FIG. 16 is a perspective view of a fifth embodiment of the invention showing the capsule falling toward a consumable liquid.

Referring now to FIGS. 15 and 16, in a fifth embodiment of the invention, the capsule 52 has a rapidly dissolvable shell 130 of consumable material which rapidly disintegrates and dissolves upon immersion in the consumable liquid 25 releasing the additive 50. The capsule 52 is initially rigid enough to apply sufficient pressure to a heat sealed foil or membrane 132 to pivot the foil or membrane aside so as to let the capsule pass into the consumable liquid 25 in the container 11.

In another configuration of the capsule shown in FIGS. 15 and 16, the capsule 52' is a readily dissolvable solid body or pellet which disintegrates upon dropping into the liquid 25 in the container 11 (see FIGS. 1-5). The solid body or pellet 52' need not necessarily have the dissolvable shell 130 and can be made of material, such as that disclosed in U.S. Pat. No. 4,289,794 issued Sep. 115, 1981, that effervesces upon dropping into the liquid 25.

In all embodiments of the invention, the plunger 16 is prevented from being accidentally dislodged from the reservoir 70 by at least one circular rib 110 on the plunger that registers with first and second circular grooves 112 and 114 in the wall of the reservoir 70. The circular rib 110 is near the bottom of the plunger 16 while the first circular groove 112 is near the top of the reservoir 70 to releasably hold the plunger 16 in the projected position of FIGS. 1, 2, 5, 7 and 11. Preferably the rib 110 has a flat top surface. The second circular groove 114 is near the bottom of the reservoir 70 and registers with the circular rib 110 on the plunger 16 and serves as a stop to hold the plunger retracted in the reservoir while the consumable liquid 25 is being poured or drunk. While one circular rib 110 and two circular grooves 112 and 114 are shown. There may be more ribs and grooves. The ribs and grooves may also be reversed so that the rib or ribs are placed on the reservoir 30 and the grooves on the plunger 16.

Figure 32:
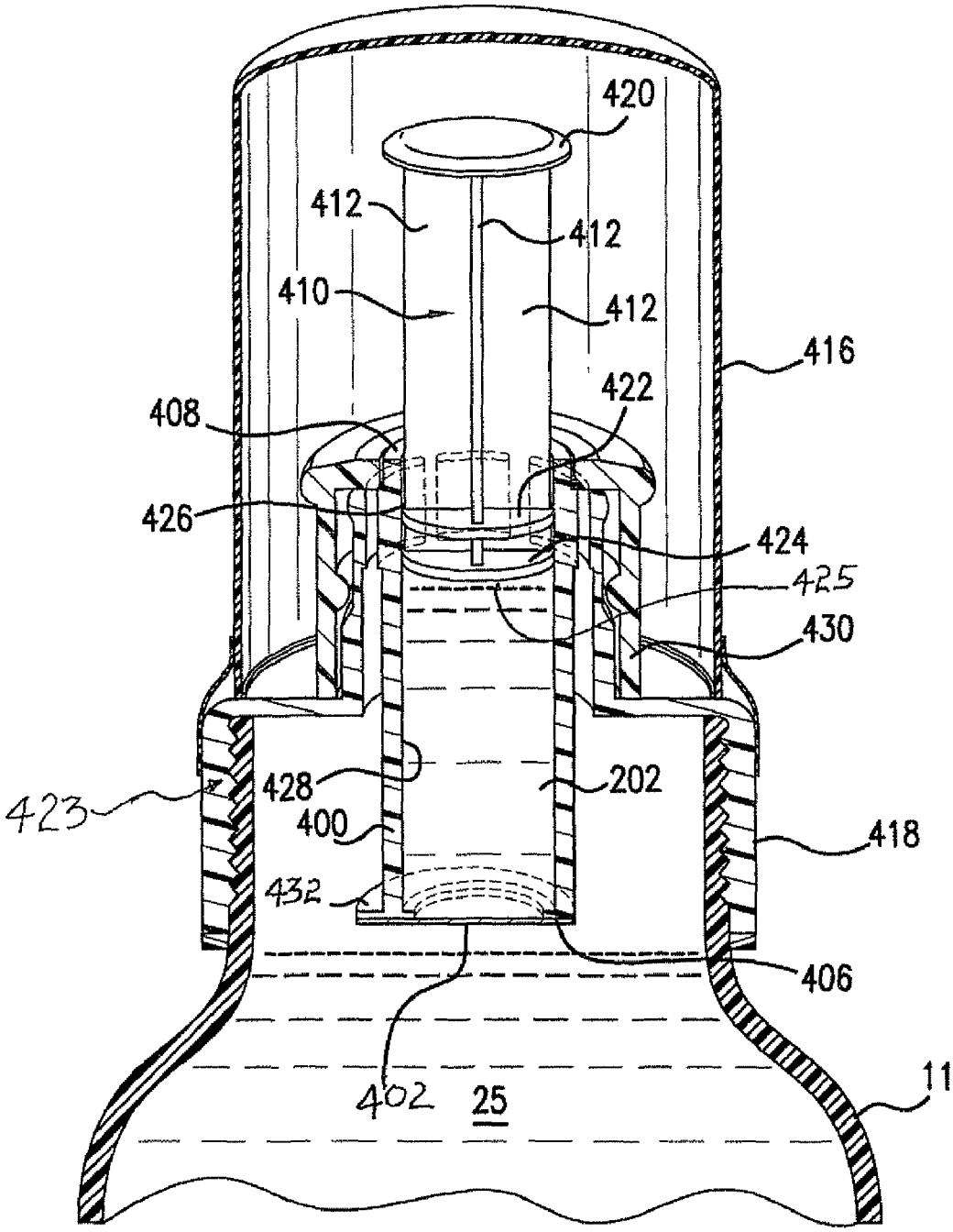
FIGS. 32-35 illustrate a ninth embodiment of the invention having figures corresponding to FIGS. 17-20 but showing a plunger with a cruciform cross section.

Referring now to the sixth embodiment of the invention set forth in FIGS. 17-27, the base 12 includes a reservoir 201 defining an additive chamber 200 that contains a liquid additive 202 sealed behind an openable barrier 204 at a an open bottom end 206 of the chamber. A support column 205 is spaced from the reservoir 201. The top end 208 of the chamber is closed by a plunger 210 that abuts the liquid additive 202 with a pressure face 212. At the first end 211 of the closure 10, the plunger 210 projects from the top end 208 of the chamber 200 by a height h. In order to minimize tampering by non-authorized persons, such as people who are not purchasers, a hard cap 216 overlies the plunger 210 and is seated adjacent an internally threaded collar 218 (as in FIGS. 32 and 33) which is integral and preferably unitary with the support column 205 and reservoir 201 that defines the additive chamber 200. The hard cap 216 may snap on to a laternal surface 220 of the base 12 and be held by an arcuate detent 222 so that the customer must apply effort to dislodge the cap 216 by for example twisting or flexing the cap 216. The hard cap 216 is optionally further secured by a frangible or breakable sealing band 224. Generally, the cap 216 is retained on the base 12 in the same manner as hard caps are retained on "sports bottles" while the base 12 is retained on the container 11 by a safety ring 225 that remains on the neck of the container if the collar 218 of the base 12 is unscrewed from the container.

Figure 21:
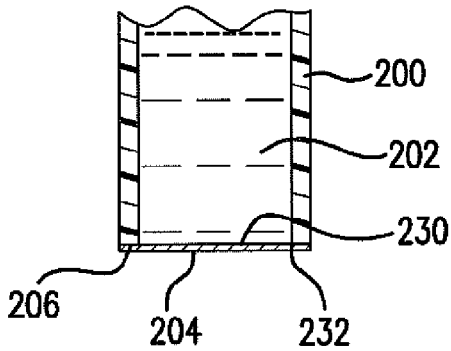
FIG. 21 is a view of an arrangement for securing the additive in the additive chamber using a membrane or foil wherein the additive chamber has an opening of a constant diameter.

As is seen in FIG. 21, the hard cap 216 is removed by the customer before the plunger 210 is activated by being pressed. This is accomplished by breaking the seal 224 and usually twisting or popping the hard cap from the surface 220 of the base 218. The top surface 230 of the plunger 210 is then pressed as is shown in FIG. 18 so that the pressure face 212 of the plunger applies sufficient pressure to the additive liquid 202 to breach the barrier 204.

Figure 18:
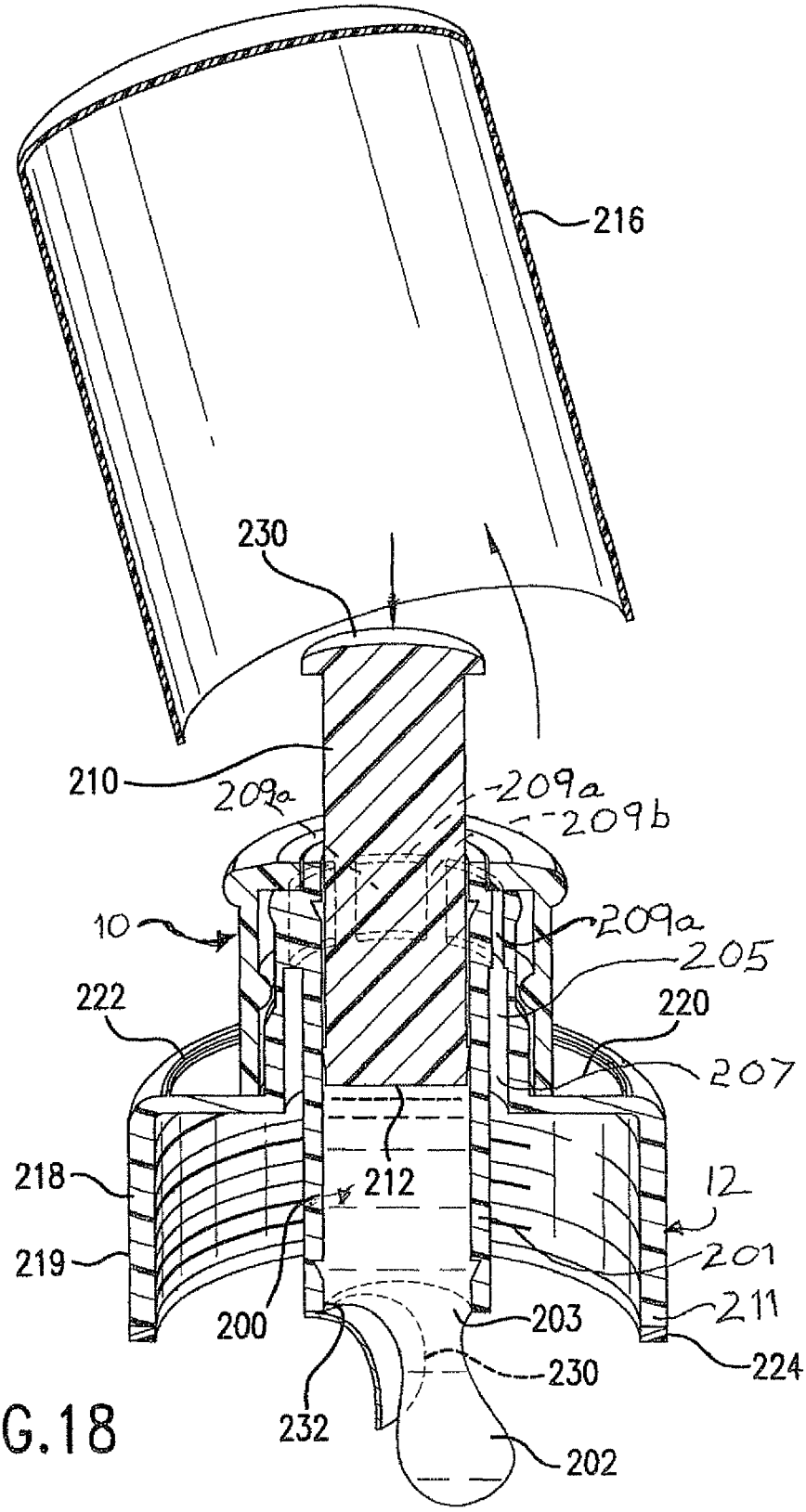
FIG. 18 is a view similar to FIG. 17, but showing the plunger being pressed to eject a liquid additive stored in the reservoir into a consumable liquid in a bottle attached to the closure.
Figure 19:
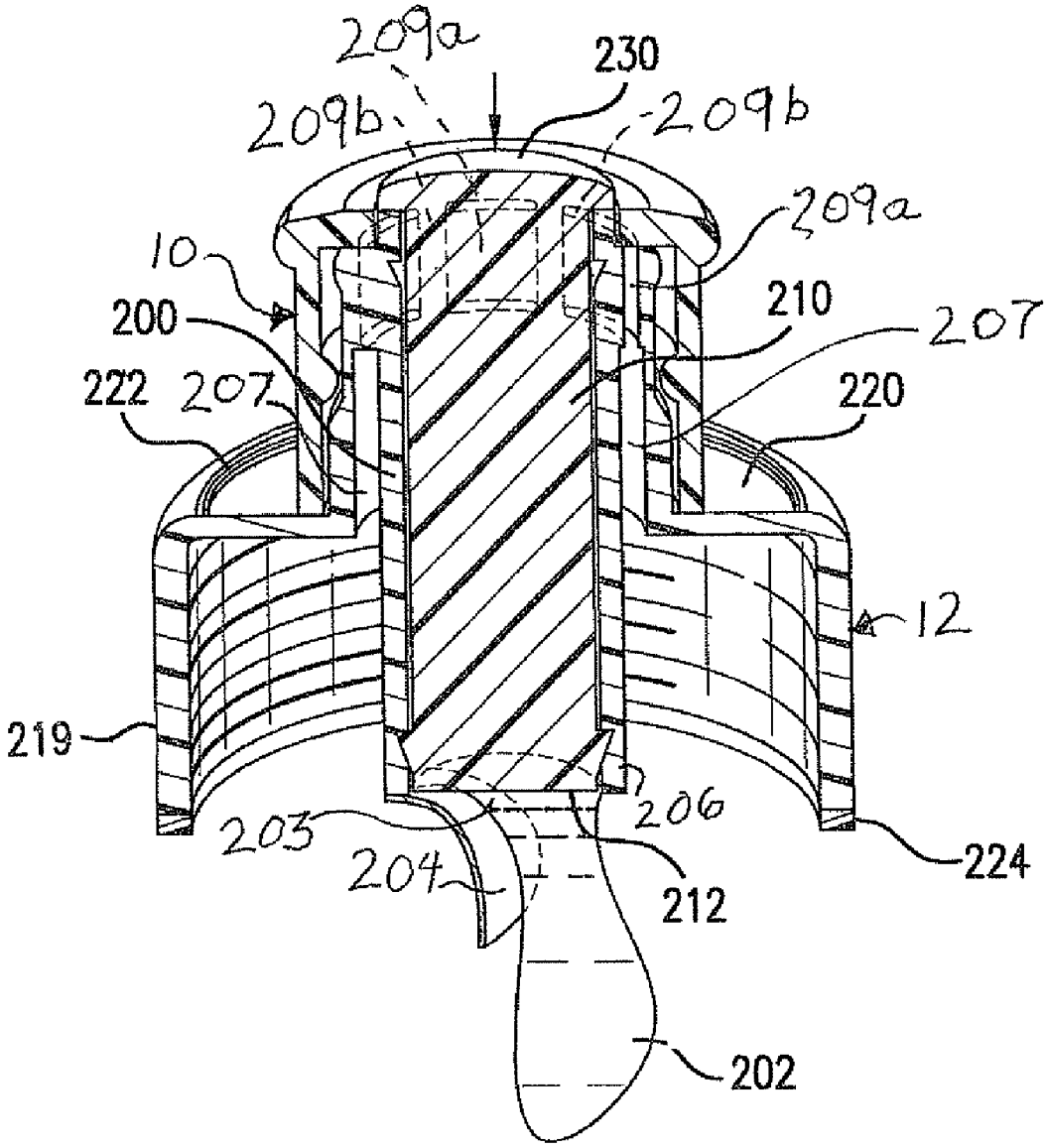
FIG. 19 is a view similar to FIGS. 17 and 18, but showing the plunger completely pressed down.

FIG. 18 shows one approach to breaching the barrier 204. The barrier 204 is a flap which is breached by pressure on the liquid 202 that causes the barrier to detach from the opening 203 of the chamber 202 along a first portion 230 of the periphery of the barrier 204 while remaining secured to the opening 203 along a second peripheral portion 332. The additive liquid 202 continues to flow into the liquid 25 of the attached container 11 after the barrier is breached. As is seen in FIG. 19, once the plunger 210 is pressed all the way down so that the top end 230 of the plunger engages with the top end 208 of the chamber 200, the liquid 202 is completely pushed out and emptied from the chamber by the pressure face 212 of the plunger 210. This can be insured by the plunger having a length sufficient to push the pressure face 212 to the bottom end 206 of the chamber 200.

Figure 20:
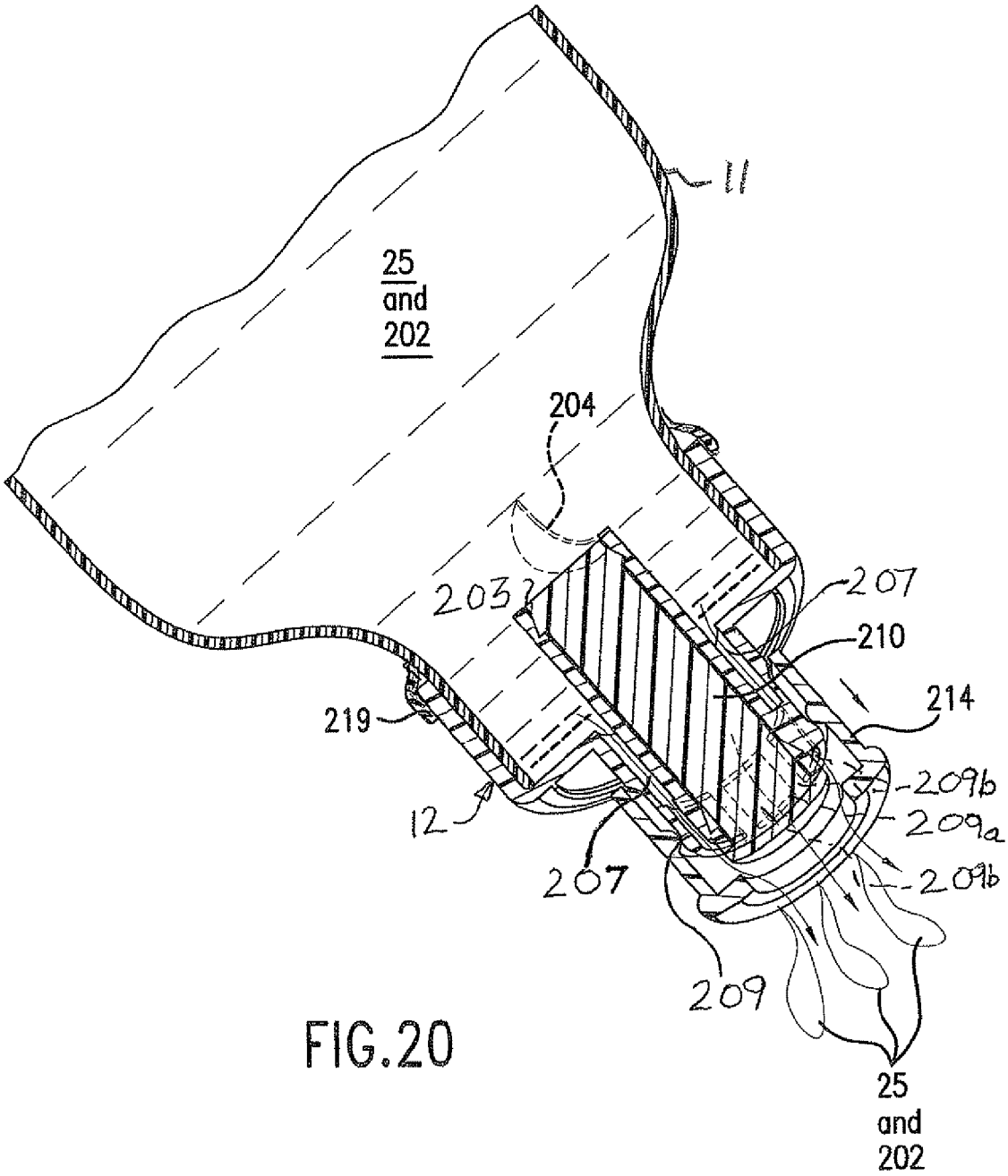
FIG. 20 is a view showing the embodiment of FIGS. 17-19 with a spout opened to enable the beverage or liquid therein to drain from a container to the consumer.

As is seen in FIG. 20, which is similar to FIG. 5, after the spout 214 is pulled in the direction of arrow 215, the liquid 25 in the container 11, that is now mixed with the liquid additive 202, is drained from the container by tilting the container so that the liquid 25 flows around the reservoir 201 and additive chamber 200 and through the passageway 207. The liquid then exits through the outlet arrangement 209 via the outlets **209*a* defined by ribs 209*b* and flows out through the lifted spout 214. Thus, the consumable liquid 25 in the container 10 mixed with the additive 202 enters the closure 12 through a first end 211 of the closure and leaves the closure through a second end 213** by the closure.

Referring now to FIGS. 21-27 where the barrier 204 has several configurations, the selected configuration opens upon advancing the plunger 210 as is seen in FIGS. 17-20. The first configuration is that shown in FIGS. 17-20 wherein the open end 206 is merely the cylindrical end of the additive chamber 200 with the barrier 204 heat sealed or otherwise adhered or bonded to the open end 206 of the additive chamber. In the embodiment of FIG. 17-20, the thickness of the wall of the chamber 200 is constant at the lower end 206, but the adherence is weaker at one portion of the heat welded joint between the barrier 204 and the end 206, than at another portion, so that the barrier 204 operates as the flap as shown in FIGS. 18-20 where the flap is hinged at peripheral portion 232 and dislodged along peripheral portion 230.

Figure 22:
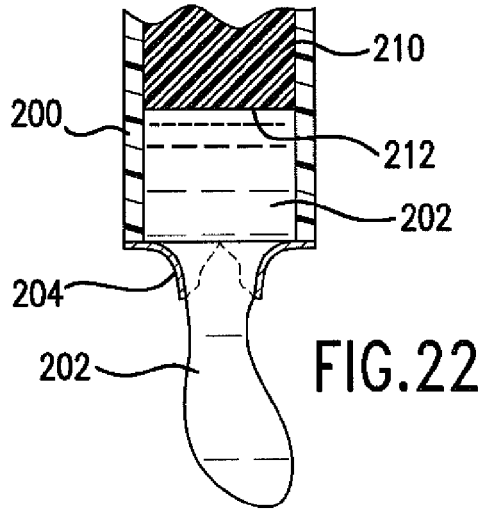
FIG. 22 is a view showing the arrangement of FIG. 21 after the membrane or foil has been ruptured showing the additive draining from the additive chamber through the rupture in the foil.
Figure 25:
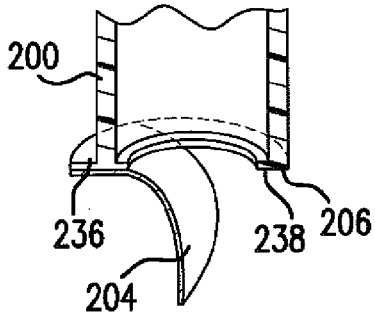
FIG. 25 is a side elevation of the chamber after the additive has been dispensed therefrom.

FIGS. 21 and 22 illustrate another embodiment of the barrier 204 when the barrier 204 is adhered in the same way as the barrier 204 of FIGS. 17-20 in that it is heat sealed to the end 206 of the additive chamber 200, however as is seen in FIG. 25 pressure applied by the plunger 210 causes the barrier 204 to rupture at its weakest point, which occurs at the central portion of the barrier 230 that is inboard of the periphery 232 of the barrier. Normally, the weakest point of barrier 204 occurs substantially at its center so that once the barrier is breached, the tear or tears propagate out toward the periphery 232 of the barrier allowing the liquid additive 202 to pour through the breach into the container 11 where it mixes with the beverage or other liquid 25.

Figure 23:
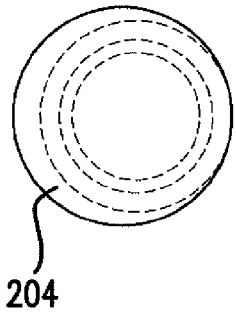
FIG. 23 is a bottom view of another arrangement for sealing the additive chamber.
Figure 24:
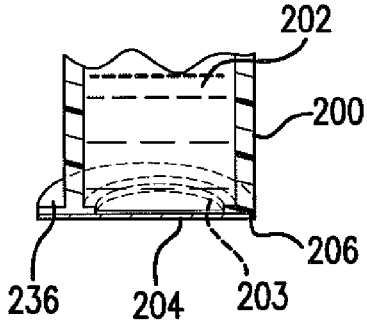
FIG. 24 is a side elevation of the bottom portion of the additive chamber of FIG. 23.

Referring now to FIGS. 23-25, in order to facilitate a barrier 204 functioning as a flap as opposed to rupturing in the suspended portion, the lower end 206 of the chamber 2000 has an arcuate flange 236 that extends partially around the circumference of the opening 203 so as to provide an increased bonding area when the barrier 204 is heat sealed to the additive chamber 200. Consequently, as seen in FIG. 25, the barrier 204 detaches more readily from the narrow portion 238 of the flange 236 or from the bottom end 206 of additive chamber 200, rather than from the wide portion of the flange 236 since there is less surface area of the barrier to bond with. Accordingly, the barrier 204 stays attached to the arcuate flange 236 over the flange's wider portion while the heat seal at the narrower portion 238 ruptures due to fluid pressure.

While heat sealing is the preferred method of attachment for the barrier 204, other methods such as adhesion with adhesives may be used in FIGS. 21-25.

As is seen in FIGS. 17-20, in order to make the closure 10 compact, the collar 218 and the support column 205 have heights which when combined do not exceed the height of the reservoir 201.

Figure 26:
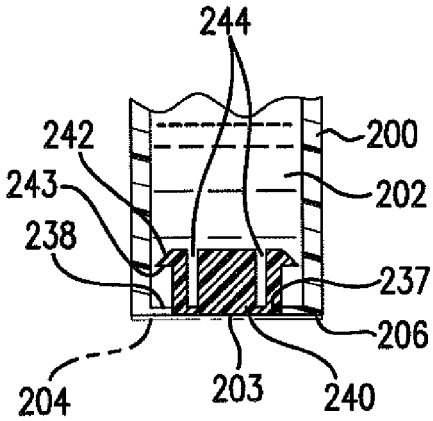
FIG. 26 is a view of still another arrangement for the additive chamber wherein a slotted plug is used to retain the additive in the additive chamber.
Figure 27:
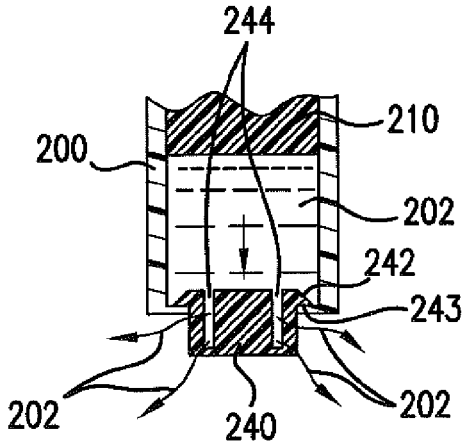
FIG. 27 is a view showing the arrangement of FIG. 26 but with the plug displaced downwardly upon advancing the plunger of FIGS. 17-20 so that the additive exits through slots in the plug.

Referring now to FIGS. 26 and 27 the barrier 204 is in the form of a vented plug 240. The vented plug seats with a sealing relation against the inner periphery 237 of a flange 238 at the opening 203 defined by the bottom end 206 of the additive container 200. The plug 240 has arms 242 with shoulders 243, the arms 242 being separated by slots 244. Upon applying pressure to the liquid 202 in the additive chamber 200, the plug 240 moves from the position of FIG. 26 down to the position of FIG. 27, the downward motion of the plug 240 being arrested by the shoulders 243 on the arms 242. This retains the plug 240 in place and allows the liquid 202 in the container 200 to exit through the slots 244 between the arms as the plunger 210 advances downwardly as shown in FIGS. 18 and 19. As the additive liquid 202 exits from the slots 244 between the arms 242, it flows into the liquid 25 to form the beverage or other consumable liquid being dispensed in FIG. 20. Optionally, the vented plug has an overlying membrane or foil 204 which is breached by pressure from the plug 240 on the membrane or foil.

In each case the barrier of FIGS. 21-27, although ruptured or breached, does not enter the beverage 25 due to peripheral adherence with the additive chamber opening.

Figure 17:
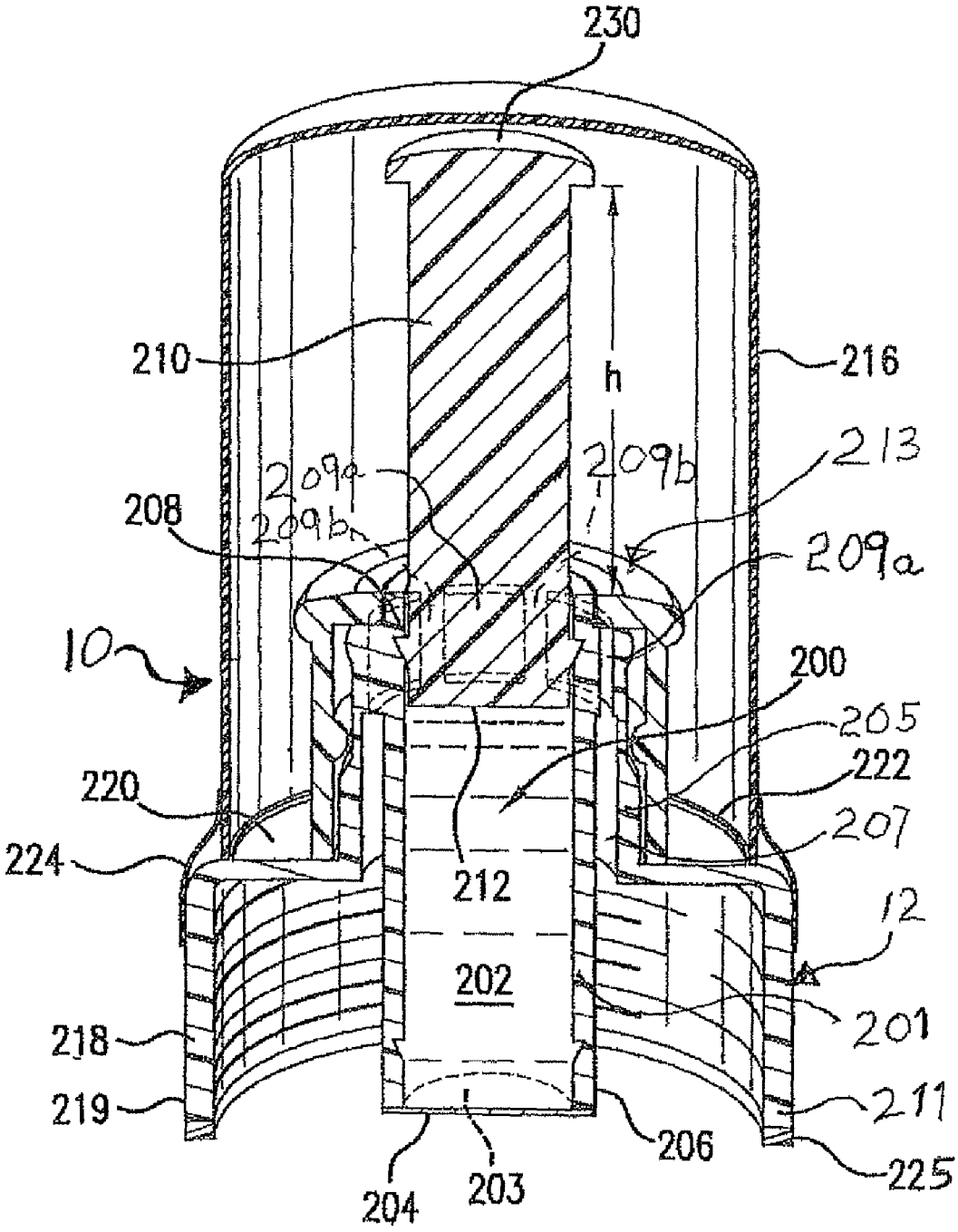
FIG. 17 is a perspective elevation of a sixth embodiment of the invention showing the enclosure containing the additive wherein the additive is in the form of an unencapsulated liquid.
Figure 28:
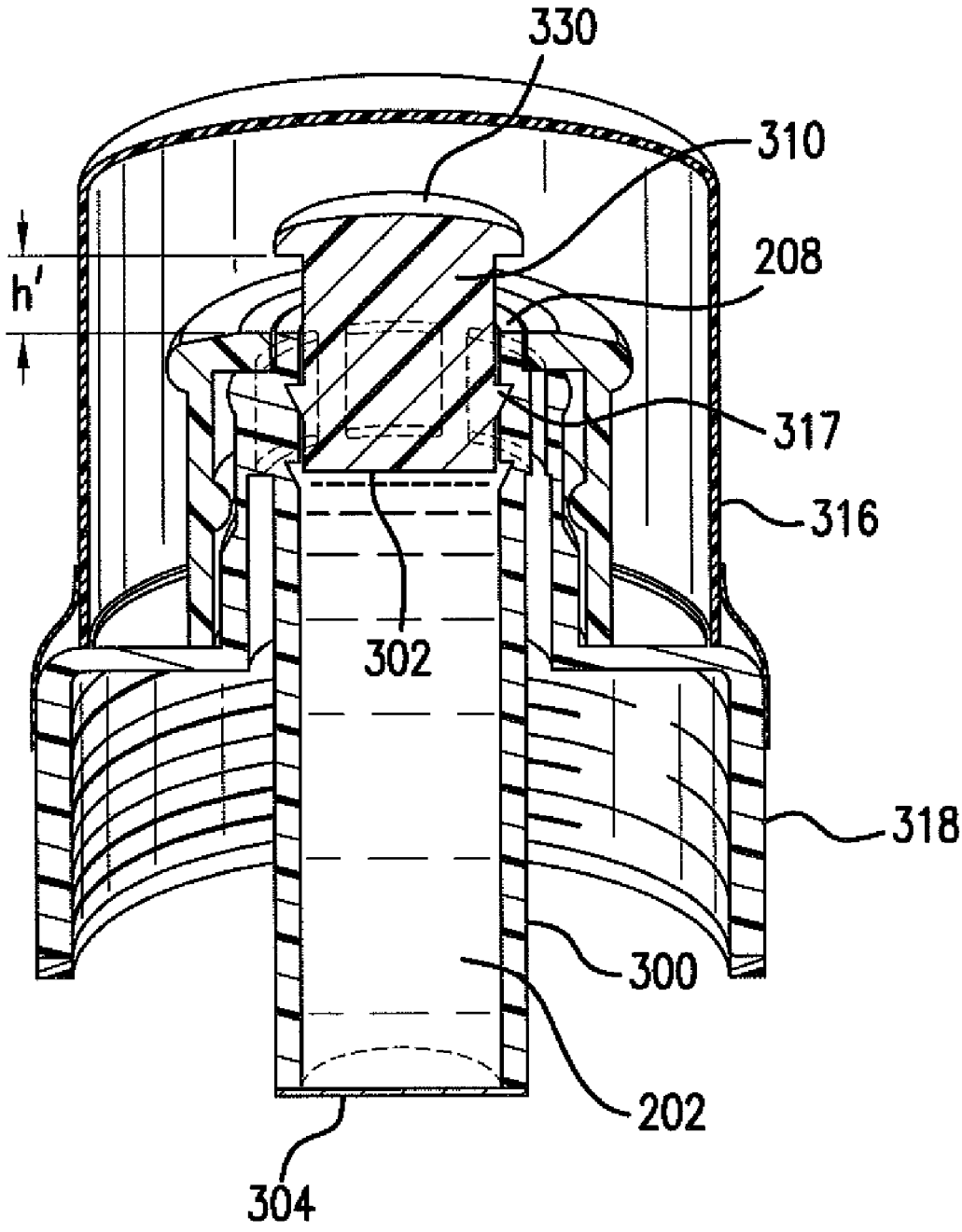
FIG. 28 is a seventh embodiment of the invention showing a plunger of decreased length and a reservoir of increased length.
Figure 29:
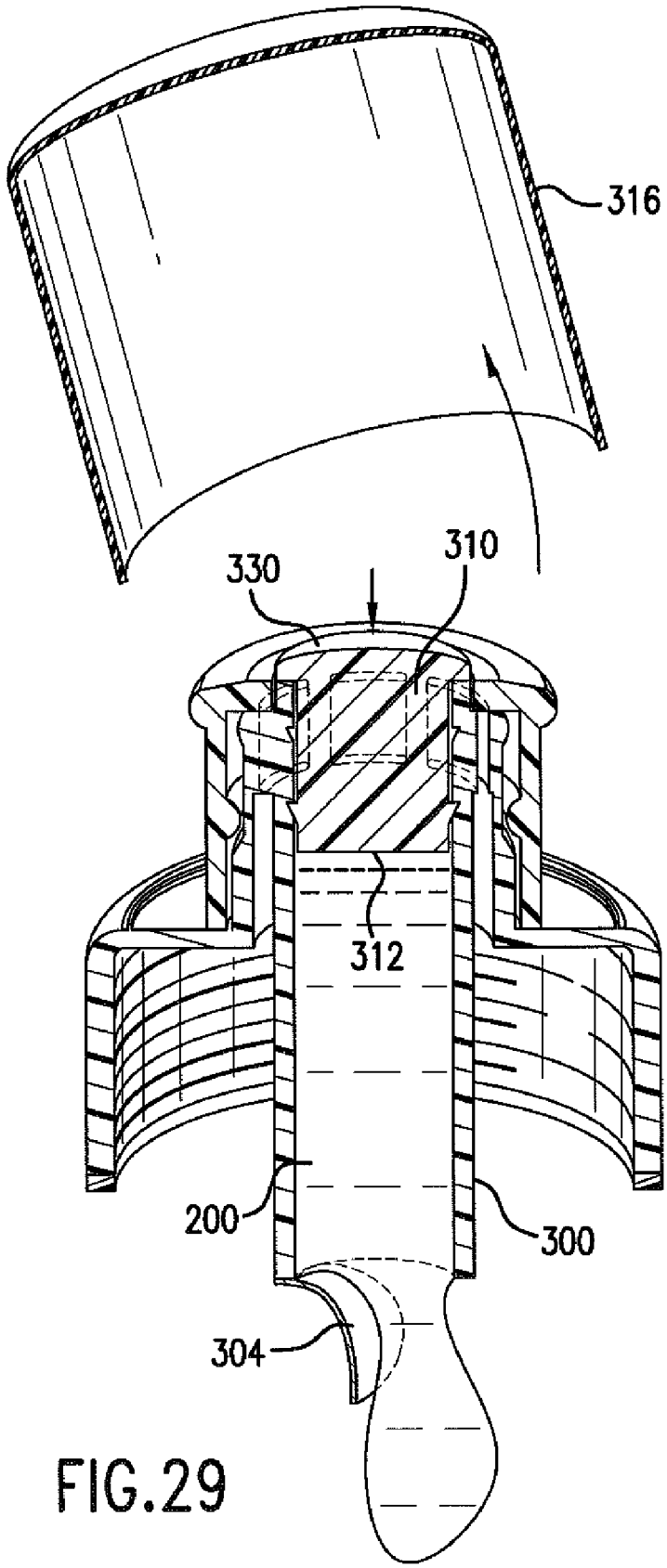
FIG. 29 is a view similar to FIG. 28 but showing the protective hard cap removed and the plunger pressed to eject liquid from the reservoir of the cap.

Referring now to FIGS. 28 and 29, where a seventh embodiment of the invention is shown the plunger 310 has a second configuration wherein its length from the free end 330 of the plunger to the pressure face 302 is substantially reduced so that the plunger extends only a distance h' from the top end 208 of the chamber 200 which is less than the height of the plunger 210 of FIG. 17. A comparison of FIG. 28 with FIG. 17 shows that the plunger 310 has a lower profile than the plunger 210 so that the free end 330 of the plunger does not extend initially as far above the top end 208 of the chamber 200 as the plunger 210 of FIG. 17. Consequently, the hard cap 316 has a height substantially less than the hard cap 216 of FIG. 17. This gives the height of the container 12 having the liquid 25 therein a height which can be similar to the height of containers with sports caps already on the market. The additive chamber 300 has notches or ribs 317 on the interior wall thereof for keeping the plunger 310 within the additive chamber, both before and after the plunger is pressed. The height of the collar 318 of the threaded base is the same.

As is seen in FIG. 29, when the cap 316 is removed and the plunger 310 is pressed downwardly by pushing on the surface 330, pressure from the face of the plunger 312 is transmitted to the barrier 304 so as to open the barrier in the same manner that the barrier 204 is opened in FIGS. 18-27. The barrier 304 can have the same configuration as any of the barriers shown in FIGS. 17-27 or the configuration of any other barriers capable of responding to pressure. Since liquids, such as the liquid 202, is for all practical purposes incompressible, the length of the plungers 310 and 210 are not only determined primarily by the amount of pressure necessary to stress the barriers 204 and 304, but also by sufficient pressure required to open the barriers. In the sixth embodiment of FIG. 17-20, physical contact with liquid 202 by the pressure face 212 ensures that the liquid is substantially removed by the pressure face 212 since the pressure face 212 travels all the way to the bottom end 206 of the additive chamber 200. In the seventh embodiment of FIGS. 28 and 29, the short distance h' that the plunger 310 travels is sufficient to both open the barrier 304 and sufficient to cause substantial evacuation of the chamber 300 due to travel of the pressure face 312 into the chamber 300.

Figure 30:
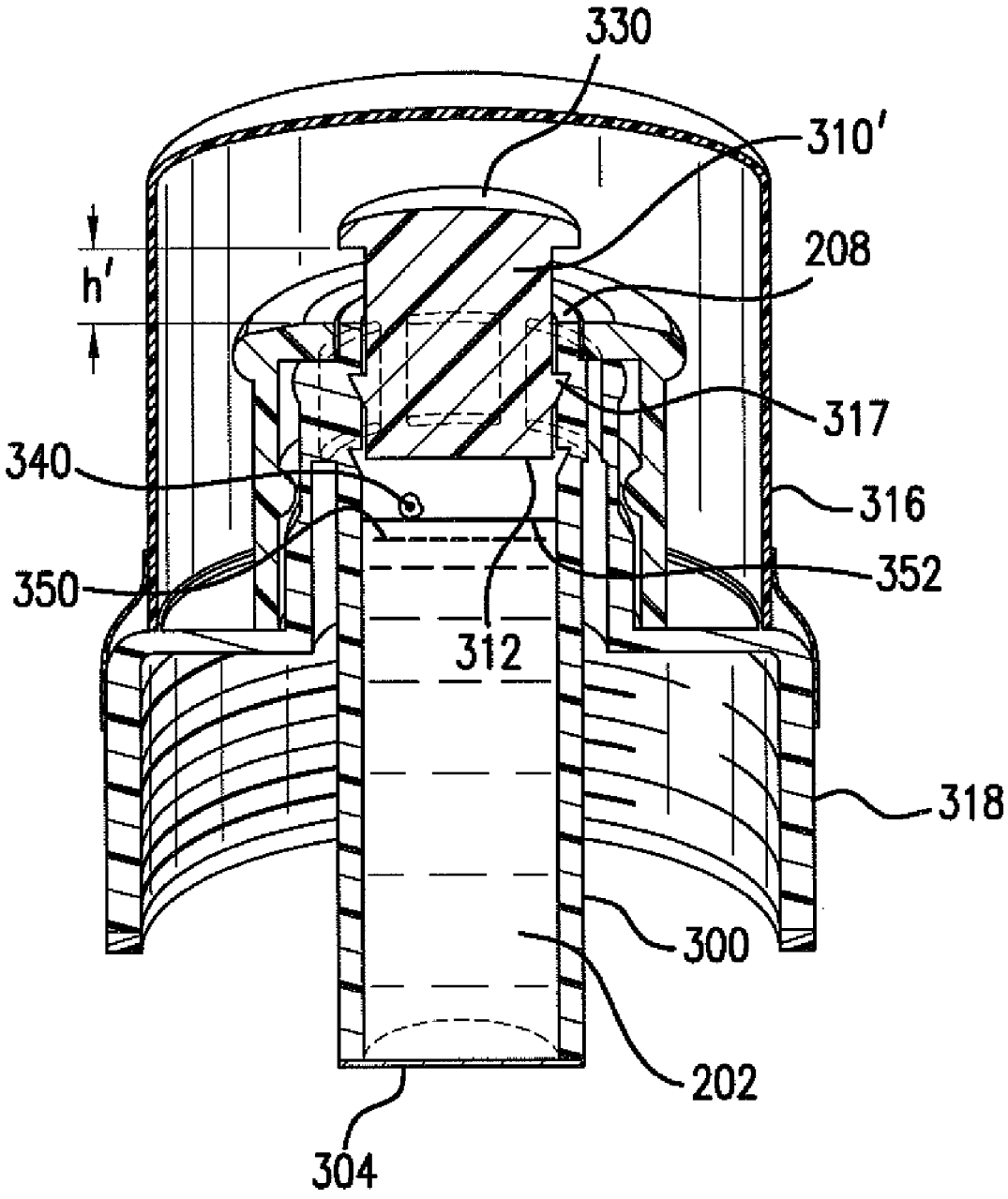
FIG. 30 is an eighth embodiment of the invention wherein a gas assist is used to empty the additive chamber upon pressing the plunger, the plunger being shown in its initial position.
Figure 31:
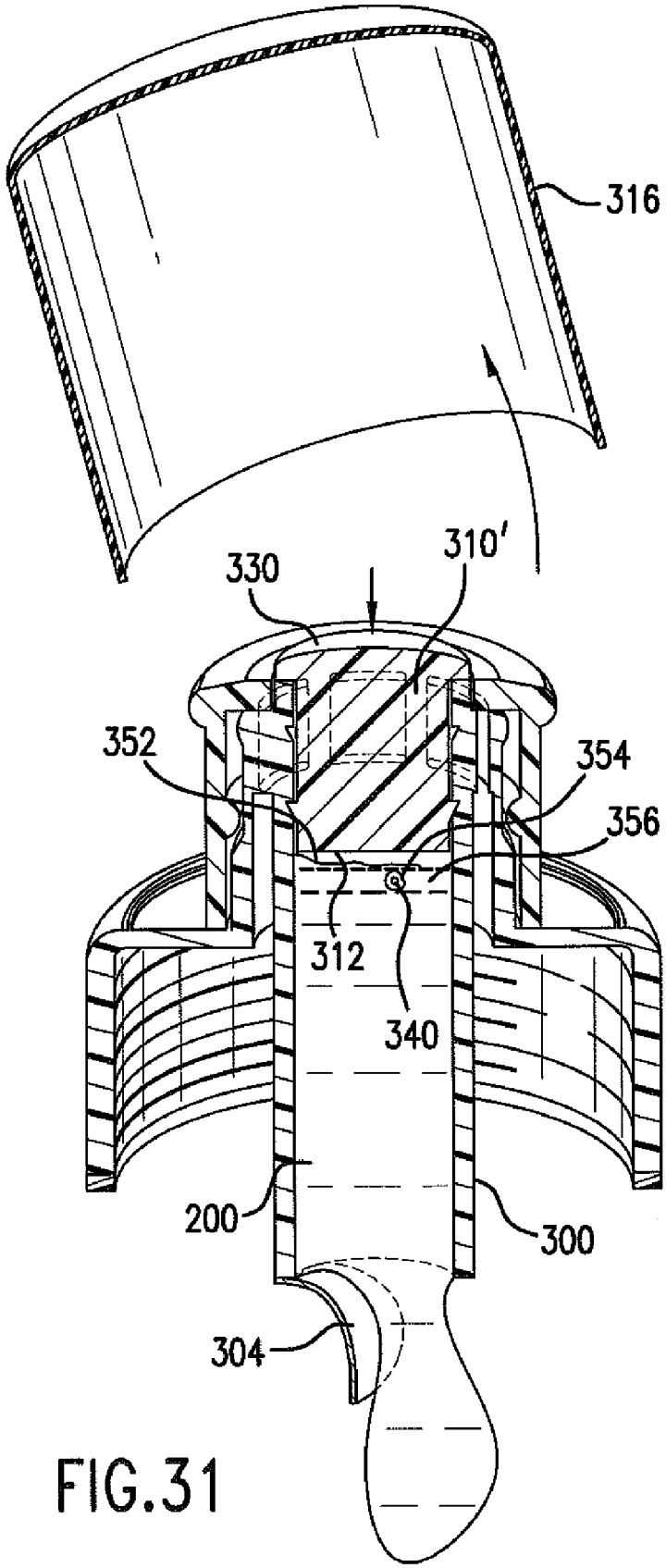
FIG. 31 is a view similar to FIG. 30 but showing the plunger depressed to open the barrier and to release the gas assist.

Referring now to FIGS. 30 and 31 where an eighth embodiment of the invention is shown, if there is resistance in the liquid 202 that prevents rapid and complete draining of the additive chamber 300, a gaseous propellant such as carbon dioxide, nitrogen or air is released into the propellant upon pressing the plunger 310. This can be accomplished by releasing into the liquid additive 202 a gas generating pellet 340 such as a "pop rock" disclosed in U.S. Pat. No. 4,289,794 issued Sep. 15, 1981. As is seen in FIG. 30, upon the pop rock dropping into the additive liquid 202, encapsulating material surrounding carbon dioxide bubbles in the pellet or pellets 340 dissolves and releases carbon dioxide which rises to or remains adjacent to the top surface 350 of the additive liquid 202 and propels the liquid past the barrier 304 and out of the open end 303 of the additive chamber 300. The carbon dioxide releasing pellet 340 may be disposed above a relative weak walled barrier 352 between the additive liquid 202 and the face 312 of the piston 310 or in a suggested embodiment of the invention, the carbon dioxide releasing pellet or pellets 340 are contained in a pouch or pouches 354 having a relatively light wall (see FIG. 31). Continued pressure on the plunger 310 opens the barrier 304 and ruptures the pouch 354, releasing carbon dioxide from the pellet or pellets 340. Carbon dioxide gas then accumulates adjacent the top surface 356 of additive liquid 202 and assists in propelling the additive liquid from the additive chamber 300.

While carbon dioxide may be a preferable gas, the gasified particles or pellets 340 may utilize other gases such as nitrogen or air. Gas generation may occur also utilizing different substances such as sodium bicarbonate, which will release carbon dioxide when dropped into the additive liquid 202 as long as the additive liquid is acidic.

Figure 33:
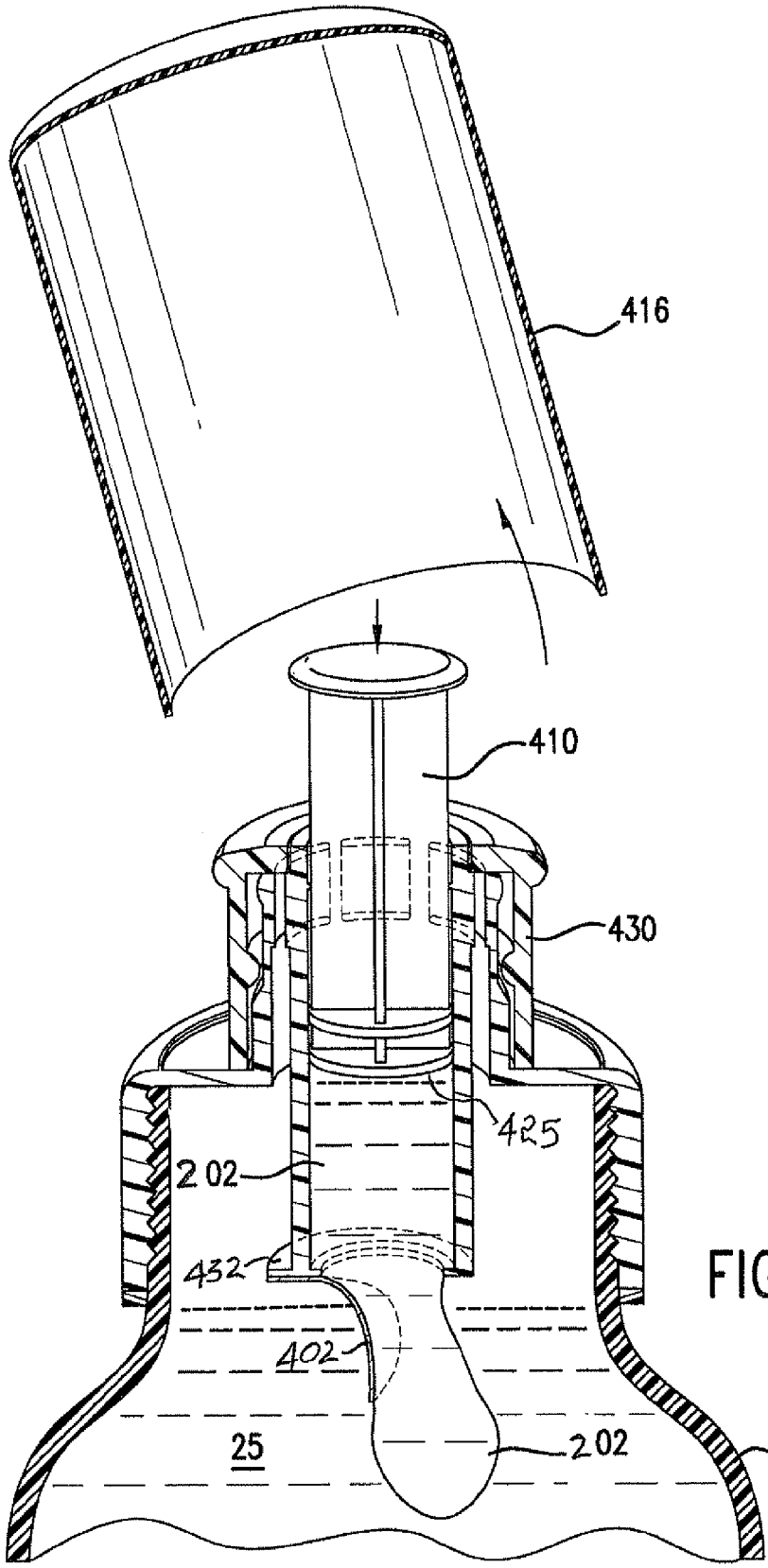
Figure 34:
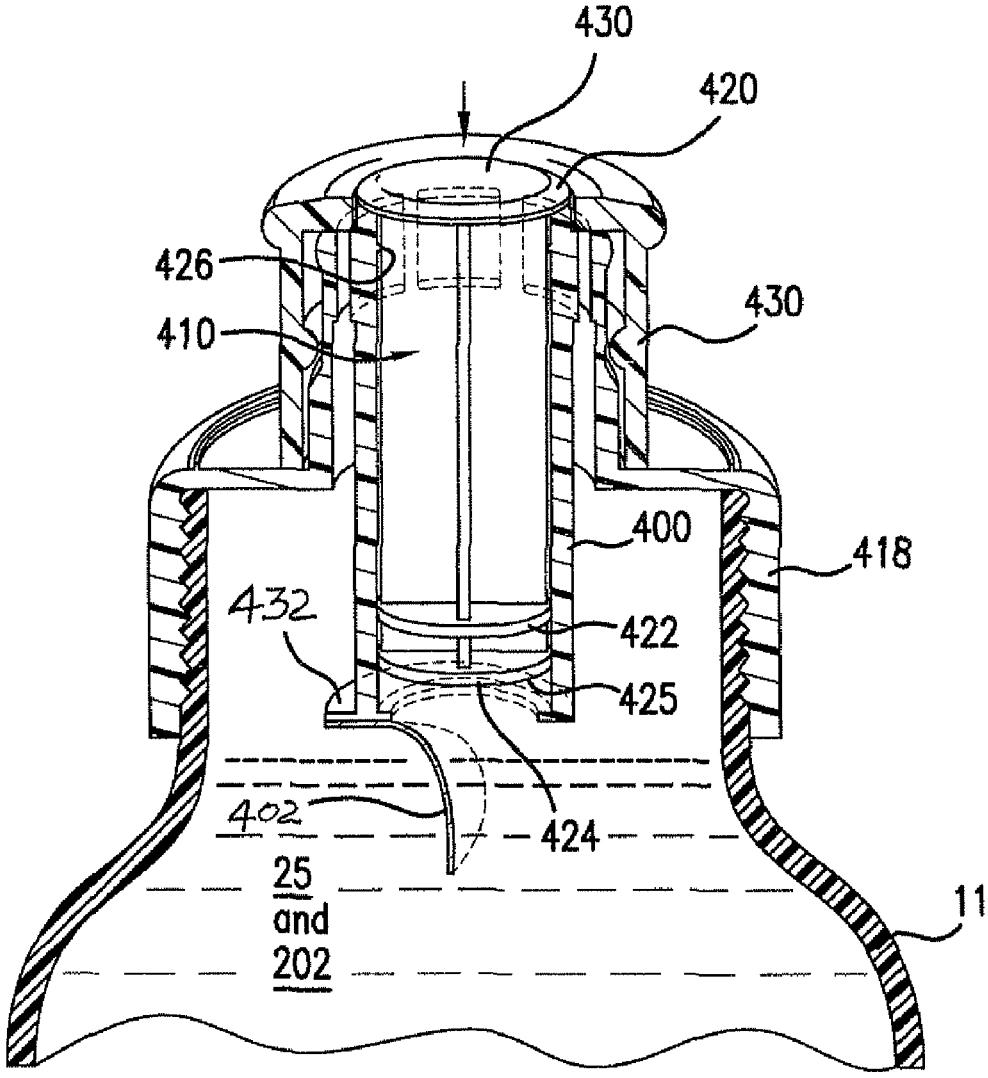
Figure 35:
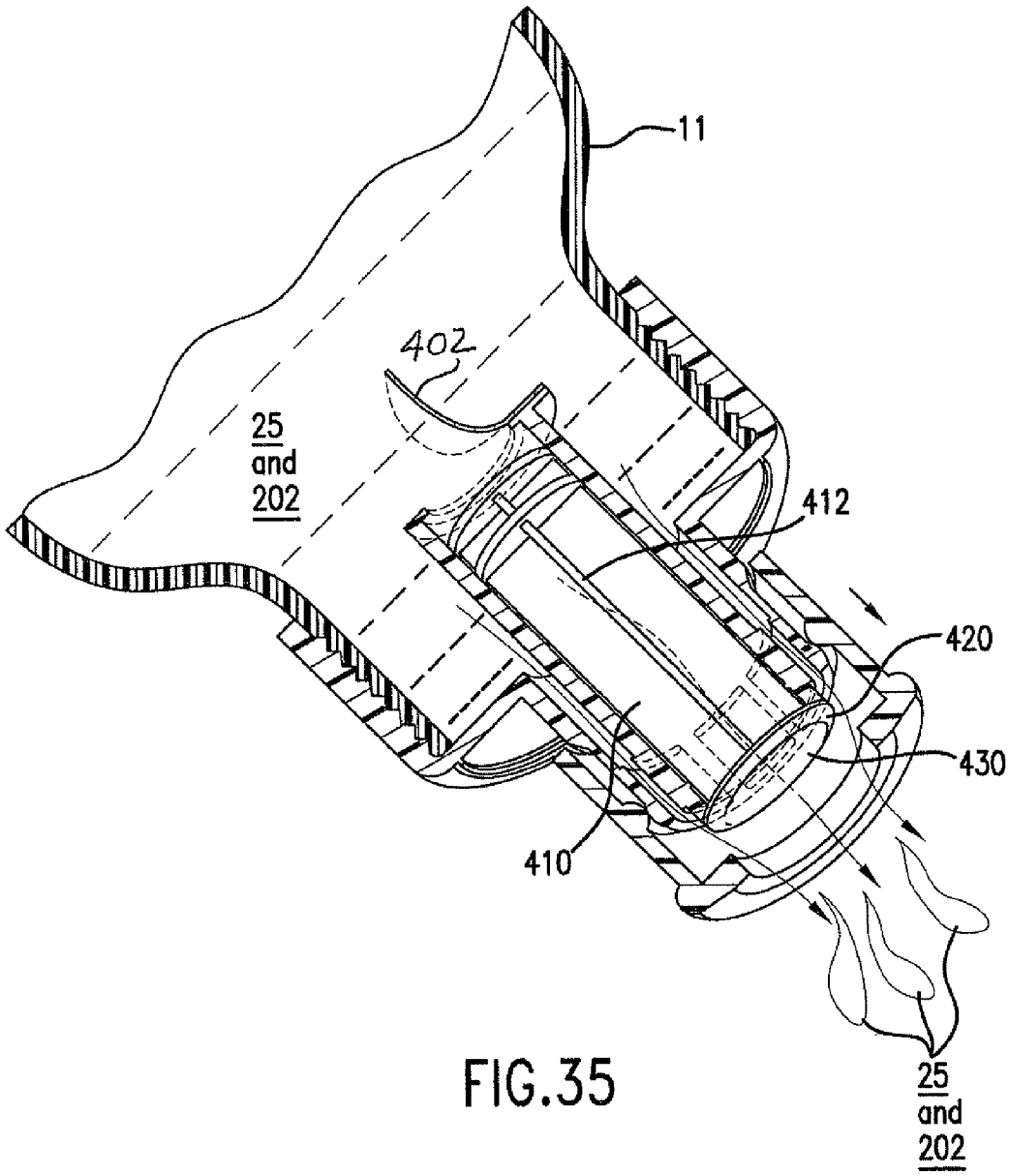

Referring now to FIGS. 32-35 where a ninth embodiment of the invention is shown, the base 423 still includes an internally threaded collar 418, but the plunger 410 has a different configuration in which the plunger is cruciform in cross-section. The plunger configuration 410 has four ribs 412, three of which are seen in the drawings and one of which is obscured in the drawings. The four ribs 412 support disks 420, 422 and 424. The disk 420 is adjacent the top of the plunger 410 and extends radially beyond the ribs 412 to engage the top end 408 of the additive chamber 400 when the plunger is pressed down in FIGS. 34 and 35. The bottom disk 424 provides a pressure surface 425 that exerts pressure on the liquid 202 when the plunger 410 is pressed to rupture or otherwise open the barrier provided by the foil or membrane 402 covering the opening of the additive chamber 400. The intermediate disk 422 engages a rib 426 on the inner wall 428 of the additive chamber 400 to prevent the plunger 410 from being withdrawn from the chamber 400. At the lower end 406 of the chamber 400, a flange 432, similar to the flange 236 in FIGS. 23-25, retains the barrier 402 in place over the opening 202. As is seen in FIGS. 33-35, upon removing the cap 416 and pressing the plunger 410, the liquid is pressurized exerting a force on the membrane or foil 402 to disengage the membrane or foil from the flange 402, which allows the additive 202 to flow down into the consumable liquid 25, thus forming a beverage which is a mixture of the consumable liquid 25 and the liquid additive 202. Upon lifting the spout 430 and inverting the container 11, the consumable liquid 25 and additive 202 pass through passageway 436 and are delivered to the consumer.

As with the embodiments of FIGS. 17-31, in the embodiment of FIGS. 32-35 the additive 204 is the sole pressure link between the pressure face 425 of the plunger 410 and barrier 402 so that pressing on the plunger 410 pressurizes the additive 204 to rupture, or otherwise, open the barrier 402 provided by the foil or membrane.

Thus far the inventors have illustrated and discussed different configurations for the additive chambers and the cooperating plungers. It is pointed out that the closure cap 10, additive chambers and plungers, as well as the barriers can have any size, shape or configuration which is consistent with rational operation of the disclosed device. For example, the closure can have a width that will cooperate with the width of the container, and the additive chamber can have a length so that it projects below the collar that retains the closure on the bottle. Moreover the cross-section of elements of the closure, while preferably circular, may be polygonal such as being rectangular, triangular, square or hexagonal, etc. In addition, the additive chamber may have a diameter which changes and which can be for example oval or oblong. The additive chamber can be of any reasonably volume, for example, one to sixty CCs.

Figure 36:
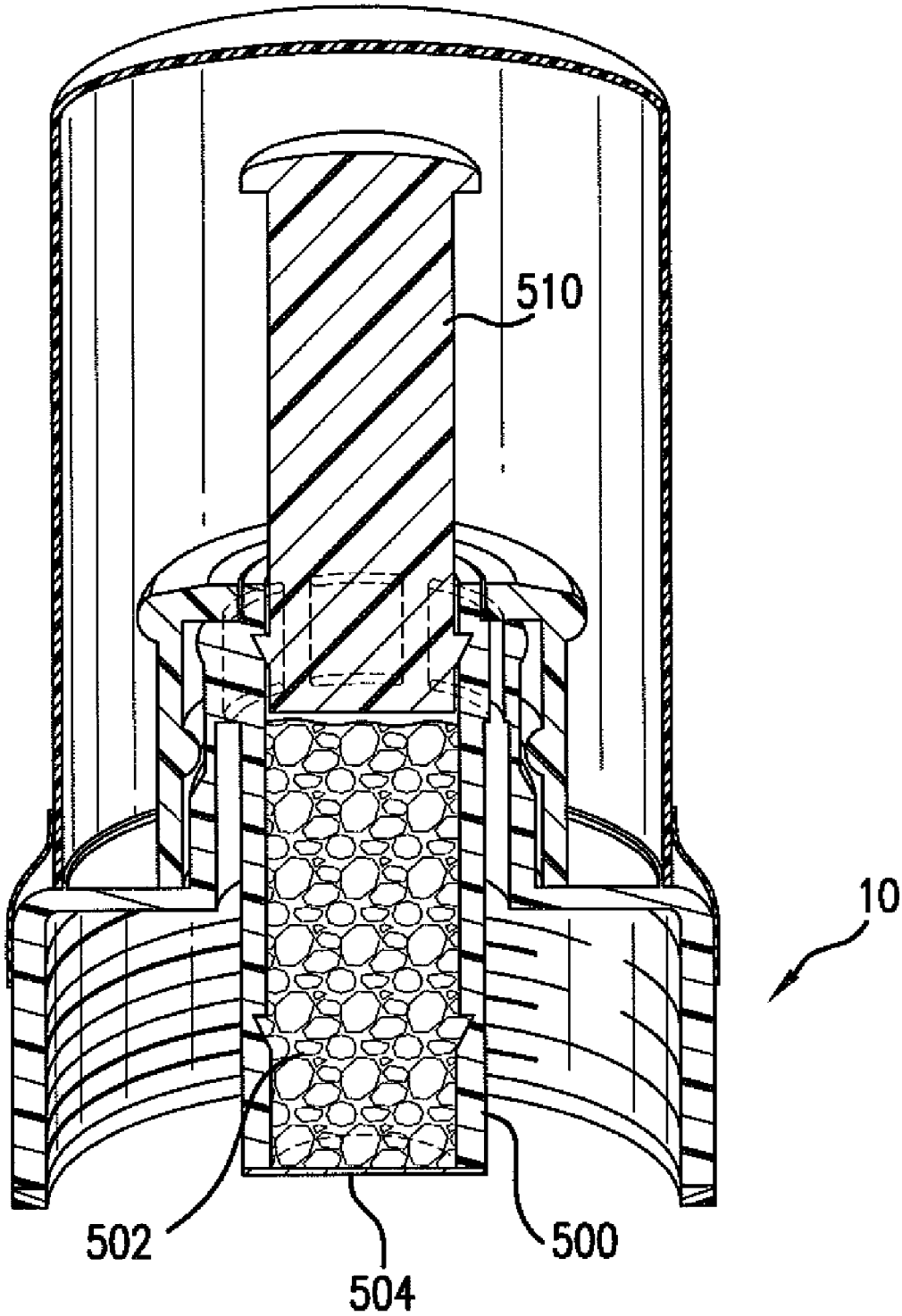
FIGS. 36 and 37 illustrate a tenth embodiment of the invention having figures corresponding to FIGS. 17 and 19 but showing a solid rather than a liquid being dispensed.
Figure 37:
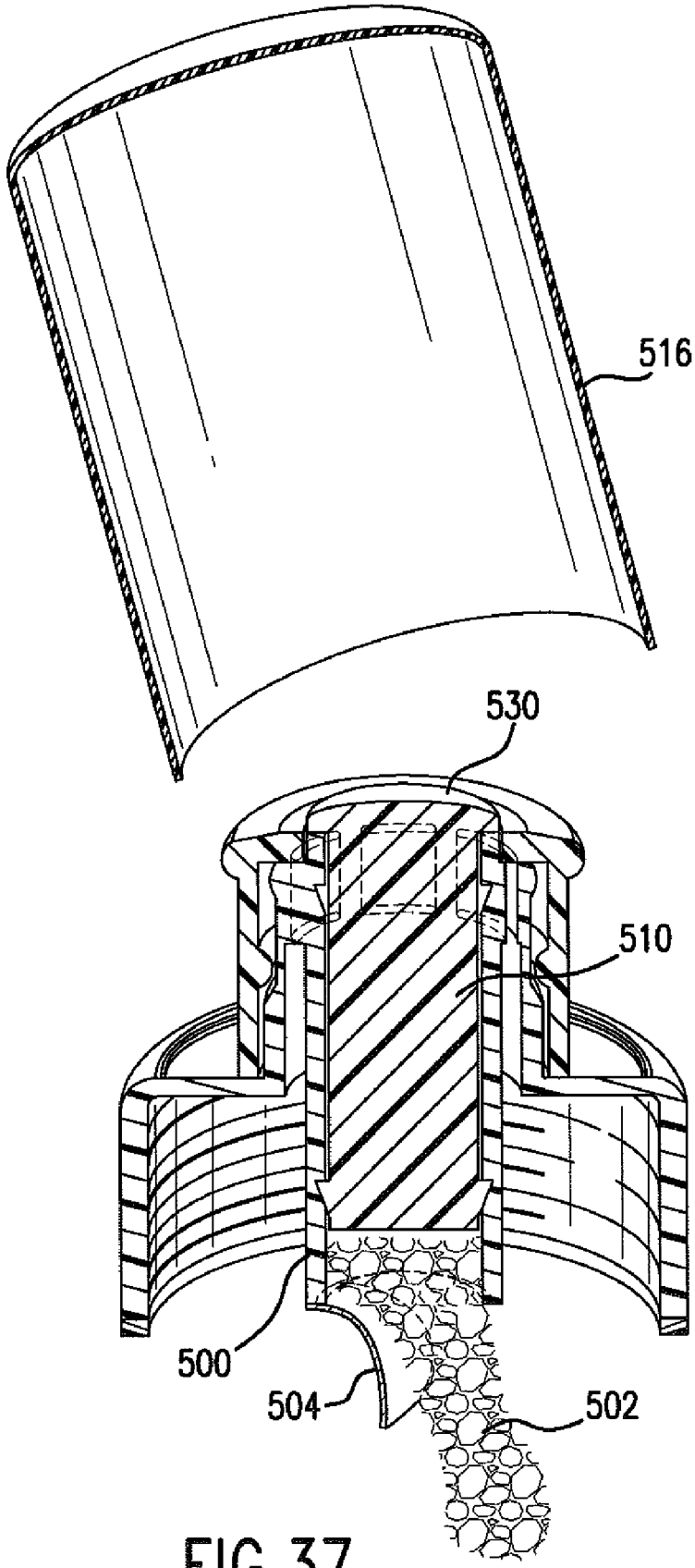

Thus far, configurations have been disclosed in FIGS. 17-37 in which a liquid additive has been dispensed. In the tenth embodiment shown in FIGS. 36 and 37, the additive 502 being dispensed is in solid form. In FIGS. 36 and 37 the configuration of the closure 10 is substantially similar to that of FIGS. 17-20, however the additive 502 that is in the form of a solid material is configured as pellets or particles which have surfaces that provide for sufficient slippage so that the pellets or particles do not bind and are capable of transmitting force down through the additive chamber 500 so as to open the barrier 504 which may have a configuration similar to the foil or membranes 204 shown in FIGS. 21-27. Pellets or particles 502 capable of transmitting force upon pressing the plunger 510 generally have a slippery or lubricating surface so that the particles or pellets can slip past one another and apply pressure against the barrier 504 so as to exert sufficient force to open the barrier.

Figure 38:
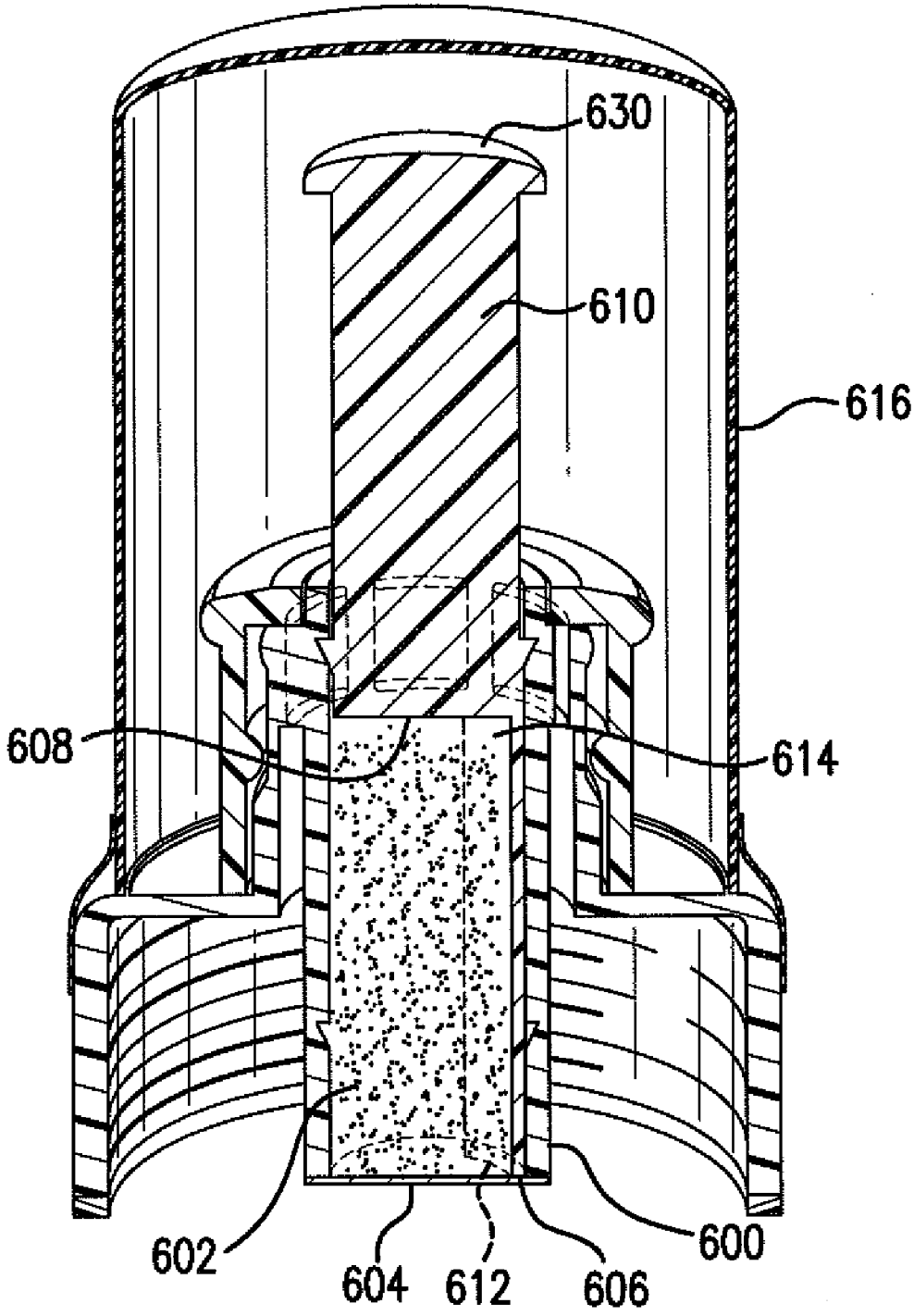
FIGS. 38 and 39 illustrate an eleventh embodiment of the invention and correspond to FIGS. 36 and 37 but show a projection extending from the plunger.
Figure 39:
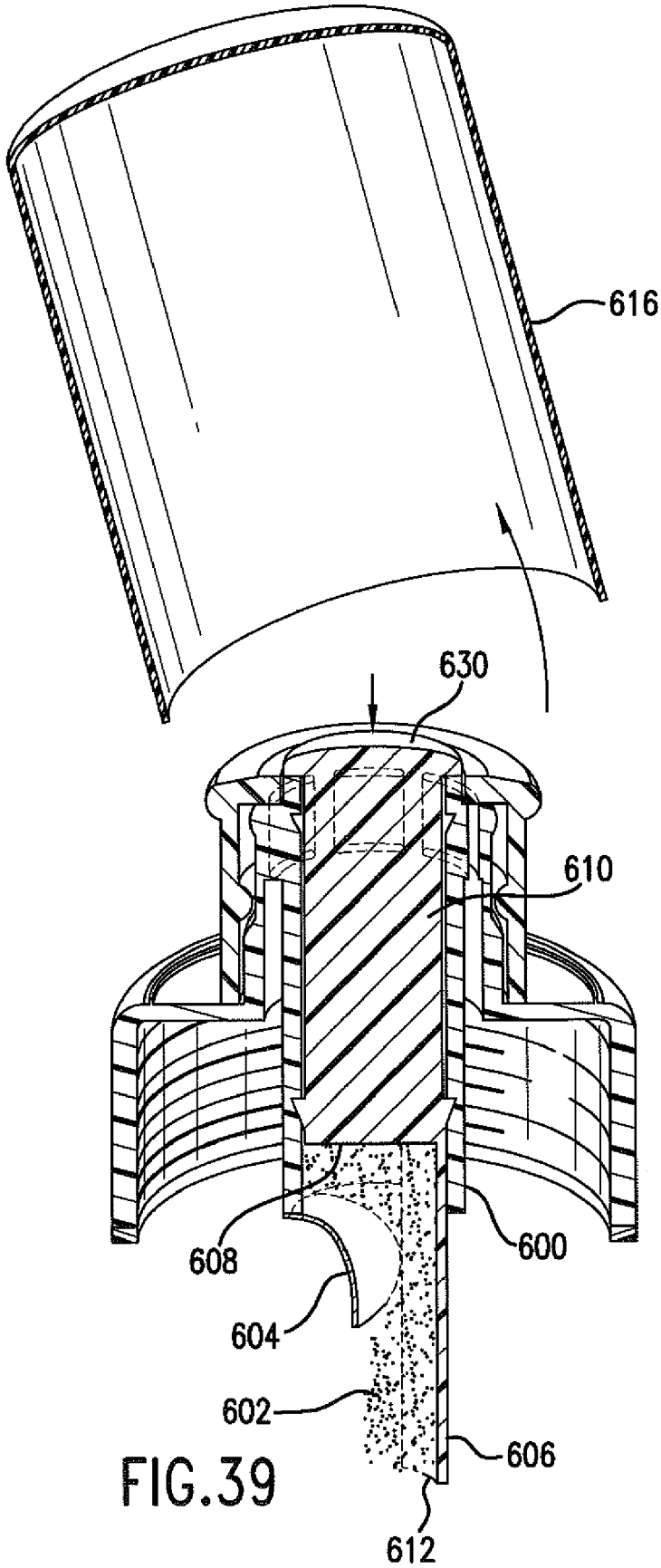

Referring now to the eleventh embodiment shown in FIGS. 38 and 39, where a solid additive in the form of a powder 602 is contained in an additive chamber 600 by a barrier 604, a plunger extension 606 preferably in the form of an arcuate blade extends from the pressure face 608 of a plunger 610. The plunger extension 606 has a bottom end 612, which engages the barrier 609 so that upon pressing on the plunger 610, direct mechanical force is applied by the bottom end 612 of the arcuate blade to the barrier. Preferably, a space 614 is provided between the top surface of the solid additive 602 so that the plunger 610 can push downwardly without being obstructed by the solid additive for a distance sufficient to allow the barrier 604 to be pushed open along one portion of the periphery as is seen in FIG. 39. The barrier is preferably a foil or membrane configured as shown in FIGS. 21-25. While the plunger extension 606 is shown as an arcuate blade in FIGS. 38 and 39, the extension may also have other configurations such as a projection extending down from the center of the plunger 610 for rupturing the barrier 604 in an area, such as the central area of the barrier.

Figure 40:
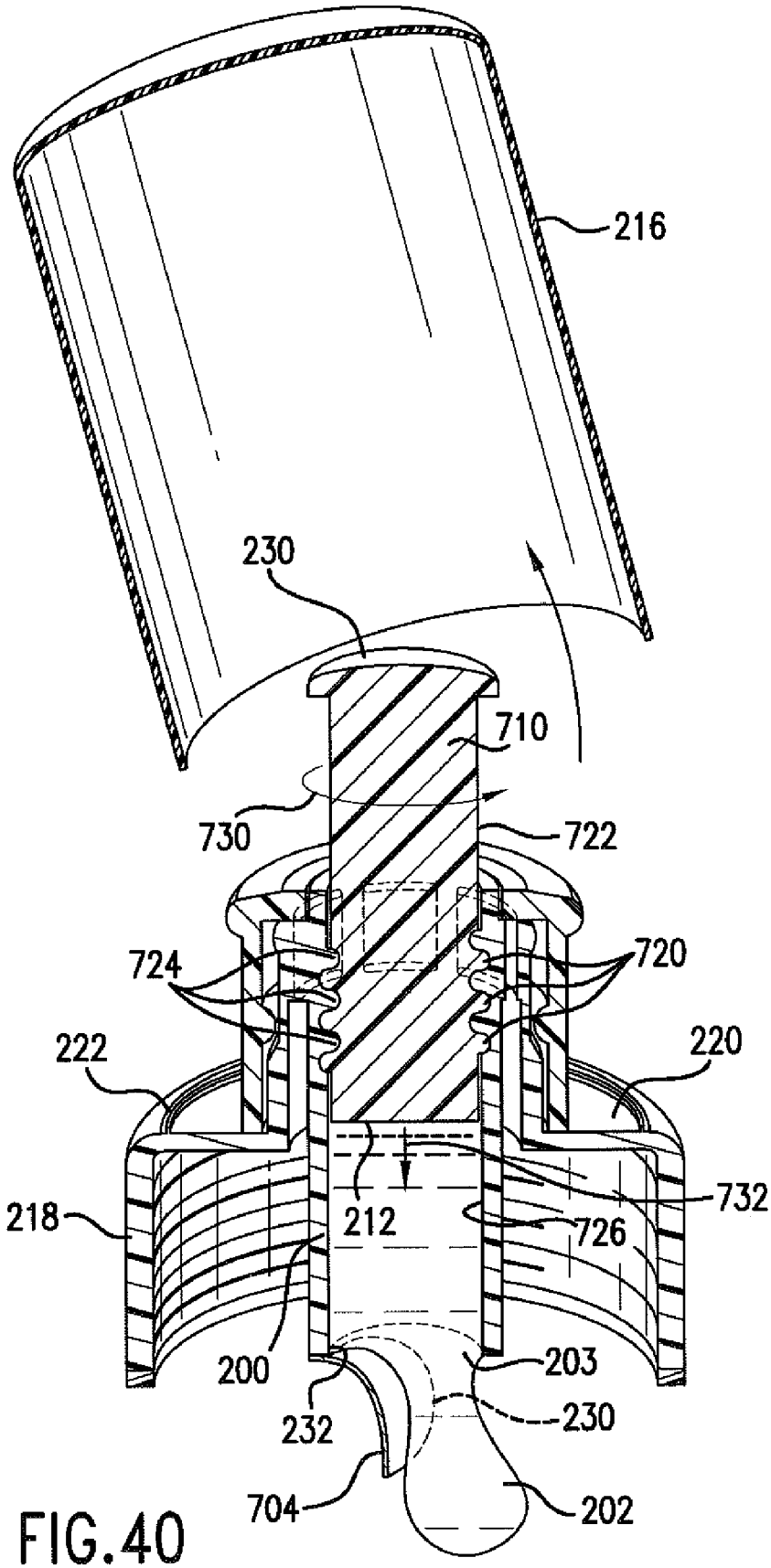
FIG. 40 is an elevation showing a twelfth embodiment of the invention wherein a plunger advances into an additive chamber upon rotation of the plunger.

While the plungers illustrated thus far are pushed in order to dislodge the additive from the additive chamber 700, the twelfth embodiment illustrated in FIG. 40 utilizes a plunger 710 that is rotated to advance toward the barrier 704 to apply increased pressure against and thus open the barrier. To facilitate rotation and advancement of the plunger 710, the plunger has a helix 720 on the outer surface 722 thereof which meshes with a helix 724 on the inner surface 726 of the additive chamber 700. Rotation of the plunger 710 in the direction of arrow 730 advances the plunger downwardly in the direction of arrow 732 to apply pressure to the liquid inside of the additive chamber 700, which pressure ruptures or otherwise breaches the barrier 704. The barrier 704, for example, can have one of the various configurations shown in FIGS. 21-27.

In each of the embodiments of the invention the length of the additive chamber may be longer than the length of the collar portion of the base. This allows a heat sealed membrane or foil barrier to be applied conveniently to the additive chamber. For example, in FIGS. 17-20 the additive chamber 200 may extend below the collar 219, as is the case in the embodiment of FIGS. 28-31.

From the foregoing description, one skilled in the art can easily ascertain the essential characteristics of this invention, and without departing form the spirit and scope thereof, can make various changes and modifications of the invention to adapt it to various usages and conditions.

We claim:

1. A closure for closing an opening of a container wherein the container is configured to contain a consumable liquid and the closure is configured to contain an additive, the closure having a first end which connects to the container and a second end through which the consumable liquid and additive are dispensed, the closure comprising:

a base including a reservoir defining an additive chamber and a support column; the support column being spaced laterally from, integral with and surrounding the reservoir and additive chamber; a passageway disposed between and extending around the support column and the reservoir, the passageway having an outlet arrangement at the second end of the closure for allowing the consumable liquid in the container to flow around the reservoir and through the outlet arrangement to a consumer, and the additive chamber having a chamber opening allowing the additive to exit therefrom into the consumable liquid, the chamber opening being closed by a barrier;

a plunger mounted in the additive chamber for movement with respect to the additive chamber and the support column, the plunger closing one end of the additive chamber and having a pressure surface for causing the additive to pressurize and open the barrier upon advancing the plunger toward the barrier, wherein the additive flows out of the additive chamber opening and into the consumable liquid, and wherein the consumable liquid and additive cannot flow back through and out of the additive chamber when dispensed;

a spout movably mounted on the support column and positioned around the plunger and the passageway, the spout having a sealed relationship with the outlet arrangement of the passageway when in a first position and an unsealed relationship with the passageway when in a second position, wherein upon moving the spout from the first to the second position and tilting the container, the consumable liquid together with the additive flows through the outlet arrangement to the consumer without having to remove the closure from the container.

2. The closure of claim 1 wherein the additive is a liquid.

3. The closure of claim 2 wherein the liquid is unencapsulated within the additive chamber and the liquid directly engages the barrier.

4. The closure of claim 2 wherein the liquid is within a gel cap and the gel cap directly engages the barrier.

5. The closure of claim 1 wherein the additive is a solid in the form of pellets, granules, powder or tablets.

6. The closure of claim 1 wherein the additive chamber is mounted within the support column with the passageway disposed between the additive chamber and the support column.

7. The closure of claim 6 wherein a stop is disposed between the plunger and the additive chamber to prevent the plunger from sliding out of the additive chamber.

8. The closure of claim 6 wherein the base, additive chamber, plunger and spout are concentric.

9. The closure of claim 8 wherein the additive is retained in the additive chamber by a membrane or foil sealing the additive chamber off with respect to the consumable liquid within the container, the membrane or foil being ruptured or dislarged dislodged upon pressing the plunger which increases pressure within the additive chamber and against the additive to cause the additive to rupture the membrane barrier.

10. The closure of claim 9 wherein the additive is in the form of a pellet, pellets, granules, powder, pills, gel and/or a liquid.

11. The closure of claim 10 wherein the additive is a colorant, flavorant or health product.

12. The closure of claim 1 further including a tamper proof and dust resistant cap fitting over the plunger and spout to protect the plunger from unauthorized activation.

13. The closure of claim 1 wherein the plunger is slidably mounted in the additive chamber whereby pushing the plunger advances the plunger toward the barrier.

14. The closure of claim 1 wherein the plunger has a first helix that cooperates with a second helix in the additive chamber, wherein rotating the plunger advances the plunger toward the barrier.

15. The closure of claim 1 wherein the base, plunger and spout are concentric.

16. The closure of claim 1 in which the plunger has a length substantially the same as the length of the additive chamber, wherein the plunger extends substantially to the barrier when pressed to remove all of the additive from the additive chamber by direct engagement with the plunger.

17. The closure of claim 1 in which the plunger has a length substantially less than the additive chamber wherein depressing the plunger is sufficient to breach the barrier allowing the additive to drain from the additive chamber.

18. The closure of claim 17 wherein the additive chamber includes a effervescing material which mixes with the additive liquid upon advancing the plunger to release a gas that helps propel the liquid from the additive chamber.

19. The closure of claim 1 wherein the additive chamber includes an effervescing material which mixes with the liquid upon depressing the plunger.

20. The closure of claim 1 wherein the additive chamber includes a vitamin or vitamins, minerals, proteins or supplements.

21. The closure of claim 1 wherein the additive chamber is disposed within a column which extends above a top surface of the base to define therebetween the passageway which allows the liquid to flow from the container to the consumer, the spout having a selected height above the top surface of the base when in the first position and the additive chamber having a height above the top surface at least proximating the height of the spout.

22. The closure of claim 21 in combination with the container.

23. The closure of claim 1 in combination with the container.

24. The closure of claim 1 wherein the pressure surface of the plunger and direct contact between the additive and barrier provides the sole pressure link between the plunger and the barrier.

25. The closure of claim 1 wherein the outlet arrangement comprises a plurality of openings between ribs supporting the reservoir on the support column.

26. The closure of claim 1 wherein the plunger has an insertion length with respect to a length of the chamber wherein the plunger remains out of direct contact with the barrier prior to the additive being pressurized to open the barrier.

27. The closure of claim 1 wherein the reservoir and support column have selected heights and wherein the base has a collar portion for attachment to the container, the collar portion having a selected height which when combined with the selected height of the support column does not exceed the selected height of the reservoir.

* * * * *